US011828436B2

(12) United States Patent
Flórez Vargas et al.

(10) Patent No.: US 11,828,436 B2
(45) Date of Patent: Nov. 28, 2023

(54) INTELLIGENT POST AND METHOD FOR CONTROLLING SAID POST

(71) Applicant: PRETENSADOS DE CONCRETO DEL ORIENTE—PRETECOR LTDA, Bucaramanga (CO)

(72) Inventors: Julián Guillermo Flórez Vargas, Bucaramanga (CO); Iván Eduardo Martínez Carrascal, Bucaramanga (CO); Daniel Fernando Montero Meza, Bucaramanga (CO); Luis Carlos Roys Pacheco, Bucaramanga (CO); Carlos Emilio Silva Parra, Bucaramanga (CO); Laura Juliana Vargas Escobar, Bucaramanga (CO)

(73) Assignee: Pretensados de Concreto del Oriente—PRETECOR Ltda., Bucaramanga (CO)

( * ) Notice: Subject to any disclaimer, the term of this patent is extended or adjusted under 35 U.S.C. 154(b) by 262 days.

(21) Appl. No.: 17/294,159

(22) PCT Filed: Nov. 15, 2019

(86) PCT No.: PCT/IB2019/059853
§ 371 (c)(1),
(2) Date: Jul. 9, 2021

(87) PCT Pub. No.: WO2020/100116
PCT Pub. Date: May 22, 2020

(65) Prior Publication Data

US 2022/0003368 A1 Jan. 6, 2022

(30) Foreign Application Priority Data

Nov. 16, 2018 (CO) ..... NC2018/0012392

(51) Int. Cl.
*G09F 13/04* (2006.01)
*F21S 8/08* (2006.01)
(Continued)

(52) U.S. Cl.
CPC ..... *F21S 8/085* (2013.01); *G09F 13/005* (2013.01); *G09F 13/0431* (2021.05); *G09F 13/22* (2013.01); *G09F 2013/222* (2013.01)

(58) Field of Classification Search
CPC .. F21S 8/0855; G09F 13/0431; G09F 13/005; G09F 2013/222; G09F 7/18; G09F 2007/1821
See application file for complete search history.

(56) References Cited

U.S. PATENT DOCUMENTS 11,242,959 B2 * 2/2022 Lu ..... F21V 23/02
2015/0198299 A1 * 7/2015 Ruiz Bonet ..... F21S 10/00 362/277

(Continued)

FOREIGN PATENT DOCUMENTS

CN 1657325 A 8/2005
CN 201875624 U 6/2011

(Continued)

OTHER PUBLICATIONS

"Are LED Signaling Poles Really Dangerous for Traffic Safety?", https://lightingequipmentsales.com/led-signalling-poles-really-dangerous-traffic-safety.html (Year: 2017).*

(Continued)

*Primary Examiner* — Gary C Hoge
(74) *Attorney, Agent, or Firm* — The Morales Law Firm; Joseph L. Morales, Esq.

(57) ABSTRACT

The present invention corresponds to a smart post, which displays visual signals, either when people approach the (Continued)

smart post, according to a predetermined programming or in response to sensor parameters, the smart post comprises a structural body with an internal cavity, said structural body being made of a translucent material, a support body disposed in the internal cavity of the structural body, wherein the support body extends longitudinally along the structural body. Furthermore, the smart post comprises a light-emitting device located between the structural body and the support body, wherein the light-emitting device is supported on the support body, with a control unit connected to the light-emitting device.

The present invention also comprises a method for controlling a smart post, comprising the following steps:

a) entering a configuration parameter in a control unit;
b) generating a control signal in the control unit based on the configuration of step a);
c) sending the control signal from the control unit to the light-emitting device;

wherein the control signal of stage c) controls the light-emitting device to emit visual signals;

wherein the visual signal may be text messages, images or light patterns.

21 Claims, 14 Drawing Sheets

(51) Int. Cl.
*G09F 13/00* (2006.01)
*G09F 13/22* (2006.01)

(56) References Cited

U.S. PATENT DOCUMENTS

| | | | | |
|---|---|---|---|---|
| 2016/0063904 | A1* | 3/2016 | Heath | B60Q 1/2657 362/545 |
| 2019/0096294 | A1* | 3/2019 | Yoshioka | G09F 13/0413 |
| 2019/0338897 | A1* | 11/2019 | Brown | F21V 5/04 |
| 2020/0342793 | A1* | 10/2020 | Patterson | G09F 13/22 |
| 2021/0134193 | A1* | 5/2021 | Pan | F21V 21/00 |
| 2021/0164177 | A1* | 6/2021 | Wientjes | G09F 13/18 |

FOREIGN PATENT DOCUMENTS

| | | | | |
|---|---|---|---|---|
| CN | 204313190 | U | 5/2015 | |
| CN | 208011573 | U | 10/2018 | |
| JP | 3201743 | U | 12/2015 | |
| KR | 20070058728 | A | 6/2007 | |
| KR | 20170070473 | A | 6/2017 | |
| KR | 101825379 | B1 | 3/2018 | |
| WO | WO-2012039070 | A1 * | 3/2012 | H05B 33/0815 |

OTHER PUBLICATIONS

AUAS and AHK students collaborate on 'Translucent' artwork, 'Something Alive' Occupies Lamppost in Amsterdam Light Festival, Amsterdam University of Applied Sciences, Dec. 15, 2016, Amsterdam.

* cited by examiner

INTELLIGENT POST AND METHOD FOR CONTROLLING SAID POST

FIELD OF INVENTION

The present invention relates to lighting posts or street lighting poles. Particularly, the present invention relates to a smart post, and a method for controlling said post.

BACKGROUND OF THE INVENTION

Existing lighting posts generally adopt a lighting system consisting of a lamp, a cable and a transformer. These types of systems are limited to illuminating the streets, thus missing the opportunity for the post to be used to display advertising or messages to people. The messages to be displayed may be decorative as well as informative. Currently, billboards or posters are generally hung on existing streetlight posts. Existing billboards or posters cannot be seen clearly at night, because they are either poorly illuminated or have no lighting. In addition, there are some billboards that are generally independently configured, have relatively simple functions and, being powered by the electrical grid, they need to consume a large amount of urban energy. In addition, these billboards or posters are outdoors, so they tend to wear out quickly and require constant maintenance.

With the development of street advertising technology using LED technology, the composition of such lighting systems mainly includes some power supply and LED lamps. Electrical power from the power supply provides working power for LED lamps. However, this type of lighting system is vulnerable to weather, because high temperatures and the presence of rain may affect the correct operation of LED lights.

In the prior art, publications related to lighting posts with smart messages are identified such as CN204313190U, CN1657325A and the non-patent document entitled "SOMETHING ALIVE OCCUPIES LAMPPOST IN AMSTERDAM LIGHT FESTIVAL".

CN204313190U discloses a street lamp, which comprises a lamp post, a LED display, a lightning rod, a photovoltaic panel, a control box, a receiver for wireless communication and a storage unit. The LED display, the photovoltaic panel and the power supply device are electrically connected to the control box. The lamp post is hollow and transparent, the LED display is placed in the cavity of the lamp post; the photovoltaic panel is movable and connects to the power supply device, the receiver and storage unit is mounted inside the control box; the photovoltaic panel has an internal device that tracks the sun, allowing the solar panel to be directed. The post may display images stored in memory, received through the wireless communication receiver or may change color according to the environment temperature or humidity.

However, since CN204313190U street lamp has the LED screen supported on the internal surface, it may be affected by the environmental conditions outside, either by the temperature outside, because the internal surface of the street lamp may transmit heat from the outside or by the presence of moisture on the internal surface of the street lamp. These adverse conditions may affect the performance of the LED display and decrease its lifetime.

In turn, CN1657325A discloses a luminescent cylinder that obtains the cylindrical shape by using a cylinder coated with a flexible LED surface, the column is coated with a luminescent LED surface coated with a transparent plastic fiber, which adopts the column shape, which may be cylindrical or square or any shape, the flexible LED surface may display customized text, images or light patterns.

However, the luminescent cylinder disclosed in CN1657325A discloses columns with a flexible LED surface, where the LEDs are located outdoors, which causes environmental conditions such as high temperatures or rain to affect the proper functioning of the LEDS.

Finally, the non-patent document discloses an artwork that was displayed at the light festival in Amsterdam from Dec. 15, 2016 to Jan. 22, 2017, however, the post will remain in place at Mr. Visserplein square for 4 years. Structurally, the post has a translucent body, and it has sensors inside a LED column with 3800 LEDs arranged inside the translucent body, which allow the light post to react to the amount of people approaching and change color and brightness, the internal arrangement responds to different signals, for example, they react to the movement of people in such a way that the operation is not obvious at first, which inspires the viewer's curiosity.

However, the non-patent document discloses that the lights of the device react when people approach by means of proximity sensors, but the lights show predetermined decorative signals, so they cannot be modified in an automatic way nor is it observed that they show any type of informative message. On the other hand, the led column does not have an internal structural support so they do not have a considerable rigidity, which could lead the led column to bend affecting the proper functioning of the LEDs, with the position of the LEDs not ensured, either. Also, the fact that the LED column is a monolithic body means that in the event that the LEDs need to be replaced, the entire LED column has to be replaced, which involves too much time and costs.

Therefore, the prior art discloses smart posts, which display smart messages. However, they do not allow the LEDS systems to be fixed inside the post, thereby preventing the LEDS systems from being affected by environmental conditions and also providing rigidity to the LEDS systems to improve their lifetime.

BRIEF DESCRIPTION OF THE INVENTION

The present invention corresponds to a smart post, which displays visual signals, either when people approach the smart post, according to a predetermined programming or in response to sensor parameters. The smart post comprises a structural body with an internal cavity, said structural body being made of a translucent material, a support body disposed in the internal cavity of the structural body, wherein the support body extends along the structural body. Further, the smart post comprises a light-emitting device located between the structural body and the support body, wherein the light-emitting device is supported on the support body, a control unit connected to the light-emitting device.

The present invention also comprises a method for controlling a smart post, comprising the steps of:

a) entering a configuration parameter in a control unit;

b) generating a control signal in the control unit based on the configuration of step a);

c) sending the control signal from the control unit to the light-emitting device;

wherein the control signal of stage c) controls the light-emitting device, in order to emit visual signals and wherein the visual signals may be text messages, images or light patterns.

BRIEF DESCRIPTION OF THE FIGURES

FIG. 4A shows a first circular positioning fixture with more than two perforations, FIG. 4B shows a second circular positioning fixture with one slot, FIG. 4C shows a third triangular positioning fixture with three slots and FIG. 4D shows a fourth hexagonal positioning fixture formed of two pieces, where said positioning fixtures have three slots.

DETAILED DESCRIPTION OF THE INVENTION

The present invention corresponds to a smart post, which allows displaying visual signals such as messages which may be, for example, advertising or informative announcements. The visual signals may be controlled by means of a control unit, whether they are predetermined visual signals or visual signals which may vary according to an external user or a condition. The visual signals will be displayed by means of a light-emitting device (e.g., LED), because it is important that the visual signal may be seen both during the day and at night and that it arises the interest of people around the smart post.

For interpretation of the present invention, a smart post is understood as a system that is computer controlled and capable of responding to changes in the environment to establish optimal operating conditions, in this case the post has the ability to display different visual signals (e.g., text messages, images, light patterns, among others), where such visual signals are controlled by at least one control unit. The associated control unit may be controlled by an external user, or also the control unit generates the visual signals depending on external conditions, such as the presence of people around the smart post, for example, the smart post only displays the visual signals in the presence of people around the smart post, otherwise the smart post does not display the visual signals.

Figure 1:
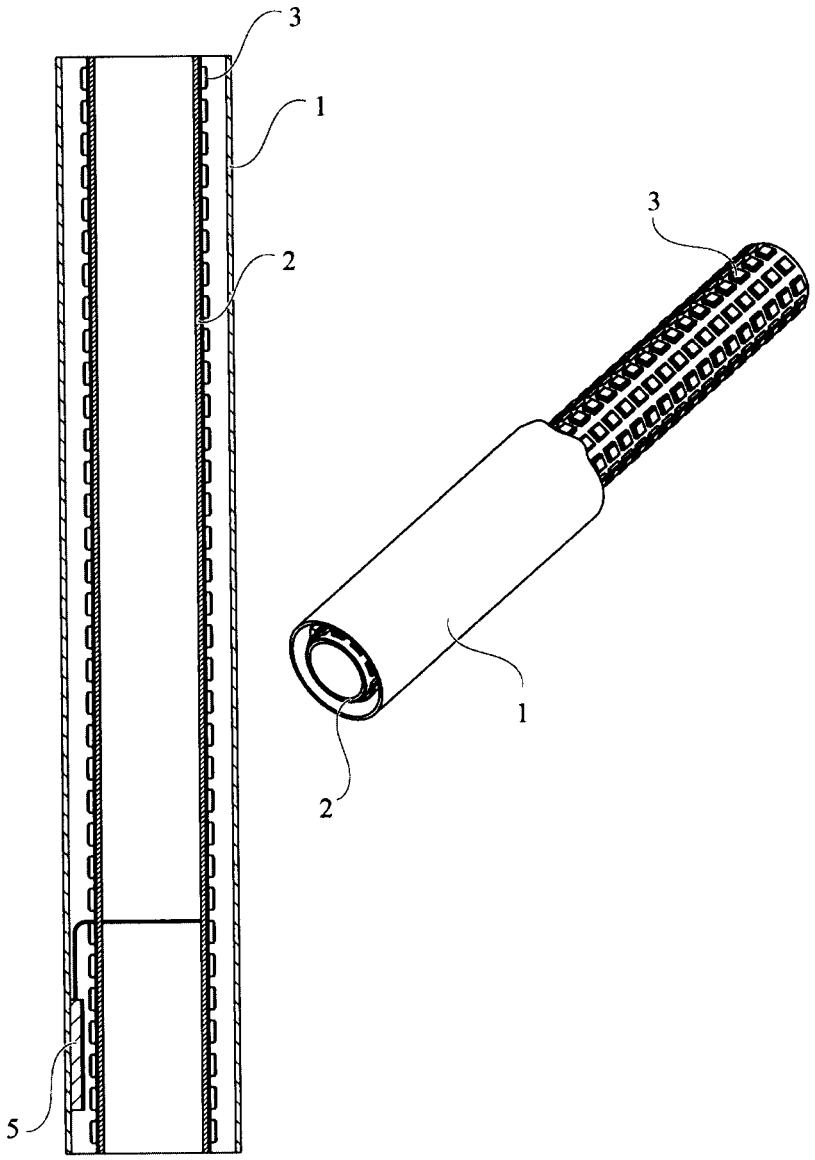
FIG. 1 shows a cross-section of a smart post embodiment comprising a structural body, a support body, a light-emitting device and a control unit.

Referring to FIG. 1, the smart post of the present invention comprises:

- a structural body (1) with an internal cavity, said structural body (1) made of a translucent material;
- a support body (2) disposed in the internal cavity of the structural body (1), wherein the support body (2) extends along the structural body (1);
- a light-emitting device (3) located between the structural body (1) and the support body (2), wherein the light-emitting device (3) is supported on the support body (2);
- a control unit (5) connected to the light-emitting device (3);

The structural body (1) with internal cavity is embedded into the floor at its base or may be coupled to a support at the base (e.g., a flange), which is screwed to the floor, at the top it may be covered by a lid. On the other hand, the structural body (1) in its upper part may have a coupling or arm for an external element, the external element may be a lamp, a traffic sign, a banner, solar panels, among others.

The structural body (1) serves to provide protection to the light-emitting device (3) and the control unit (5), preventing environmental conditions such as temperature, wind, rain, among others from making direct contact with the light-emitting device (3) and the control unit (5), thereby increasing the useful life of the light-emitting device (3). The structural body (1) of the present invention may be found in different shapes, the different shapes may improve the strength of the post. The shapes of the structural body (1) may be selected from the group consisting of truncated cone shape, cylindrical shape, pyramidal shape, orthoedric shape, shapes with polygonal cross section (e.g., square, triangular, pentagonal, hexagonal, rhomboidal) and combination thereof. In the preferred embodiment, the structural body (1) has a truncated cone shape, which improves the smart post strength.

The structural body (1) may be formed of at least two pieces that are joined together by fixing means once the smart post is installed, which facilitates the installations of the elements in the present invention and their subsequent maintenance. The pieces may be joined both longitudinally and/or transversely, depending on the needs of the smart post.

The structural body (1) is made of a translucent material, since it must allow light to pass through, so the visual signal displayed by the light-emitting device (3) may be seen. The refractive index of the structural body material (1) may be between the range of 1.5 and 1.55, whereby it is ensured that the visual signal displayed by the light-emitting device (3) may be visualized. In the preferred embodiment, the level of translucency of the structural body material (1) is in the range between 1.528 and 1.532.

The translucent material of the structural body (1) may be selected from the group consisting of glass fiber reinforced polyester (GRP), polymethylmethacrylate (PMMA), polyvinyl chloride (PVC); chlorinated polyvinyl chloride (CPVC); polyethylene terephthalate (PET), polyamides (PA) (e.g., PA12, PA6, PA66); polychlorotrifluoroethylene (PCTFE); polyvinylidene fluoride (PVDF); polytetrafluoride ethylene (PTFE); ethylene-chlorotrifluoroethylene (ECTFE); plastics (polyester, vinyl ester, epoxy, vinylic resins) reinforced with fibers (e.g., glass, aramid, polyester) and combinations thereof. In a preferred embodiment the translucent material of the structural body (1) is glass fiber reinforced polyester (GRP).

The support body (2) is arranged inside the structural body (1), wherein the support body (2) may extend longitudinally along the structural body (1). The support body (2) may have the same length as the structural body (1), but it may also be of lesser length in case the visual sign to be displayed does not require much space, thus reducing costs and manufacturing time. The shapes of the support body (2) may be selected from the group consisting of truncated cone shape, cylindrical shape, pyramidal shape, orthoedric shape, shapes with polygonal cross section (e.g., square, triangular, pentagonal, hexagonal, rhomboidal) and a combination thereof. The shape of the support body (2) may be the same shape of the structural body (1), on the other hand, optionally, the support body (2) is concentric with the structural body (1).

The support body (2) may be a rigid body (e.g., rod). On the other hand, optionally the support body (2) has an internal cavity, wherein said internal cavity may be a through-hole opening (e.g., tube). The aforesaid internal cavity allows to hide and protect the connections of the smart post elements, it also decreases the weight of the support body (2). The internal cavity of the support body (2) may also house the control unit (5), preferably in the lower part of the support body (2).

The support body (2) may be formed of at least two pieces which are joined by means of fixing means once the smart post is installed, which facilitates the installations of the present invention elements and their subsequent maintenance. The pieces may be joined both longitudinally and/or transversely, depending on the smart post needs. In a particular example, the support body (2) is formed by two arc-shaped pieces, which are joined longitudinally to form a tube.

The material of the support body (2) is optionally a structural material, which may be selected from the group consisting of steels e.g., (carbon steel, cast iron, galvanized iron, chromium steels, chromium-nickel steels, chromium-nickel-titanium steels, nickel-chromium-molybdenum-tungsten alloy, ferrous chromium-molybdenum alloys, stainless steel 301, stainless steel 302, stainless steel 304, stainless steel 316, stainless steel 405, stainless steel 410, stainless steel 430, stainless steel 442, manganese alloyed steel, among others), aluminum, plastics, e.g., polymethylmethacrylate (PMMA), polyvinyl chloride (PVC); chlorinated polyvinyl chloride (CPVC); high density polyethylene (HDPE); polypropylene (PP); polyethylene terephthalate (PET), polyamides (PA) (e.g., PA12, PA6, PA66); polychlorotrifluoroethylene (PCTFE); polyvinylidene fluoride (PVDF); polytetrafluoride ethylene (PTFE); ethylene-chlorotrifluoroethylene (ECTFE); plastics (polyester, vinyl ester, epoxy, vinyl resins) fiber-reinforced (e.g., glass, aramid, polyester), ceramics (e.g., concrete, reinforced concrete with metallic reinforcement), woods (e.g., conifers such as pine, oak and walnut, broadleaf, fir, larch, spruce, other structurally suitable woods known to a person skilled in the art), polymers (e.g., polyester, vinyl ester, epoxy, vinyl resins), fiber-reinforced (e.g., polyester, glass, aramid, carbon), other structurally suitable materials known to a person skilled in the art, or combinations thereof.

Figure 2:
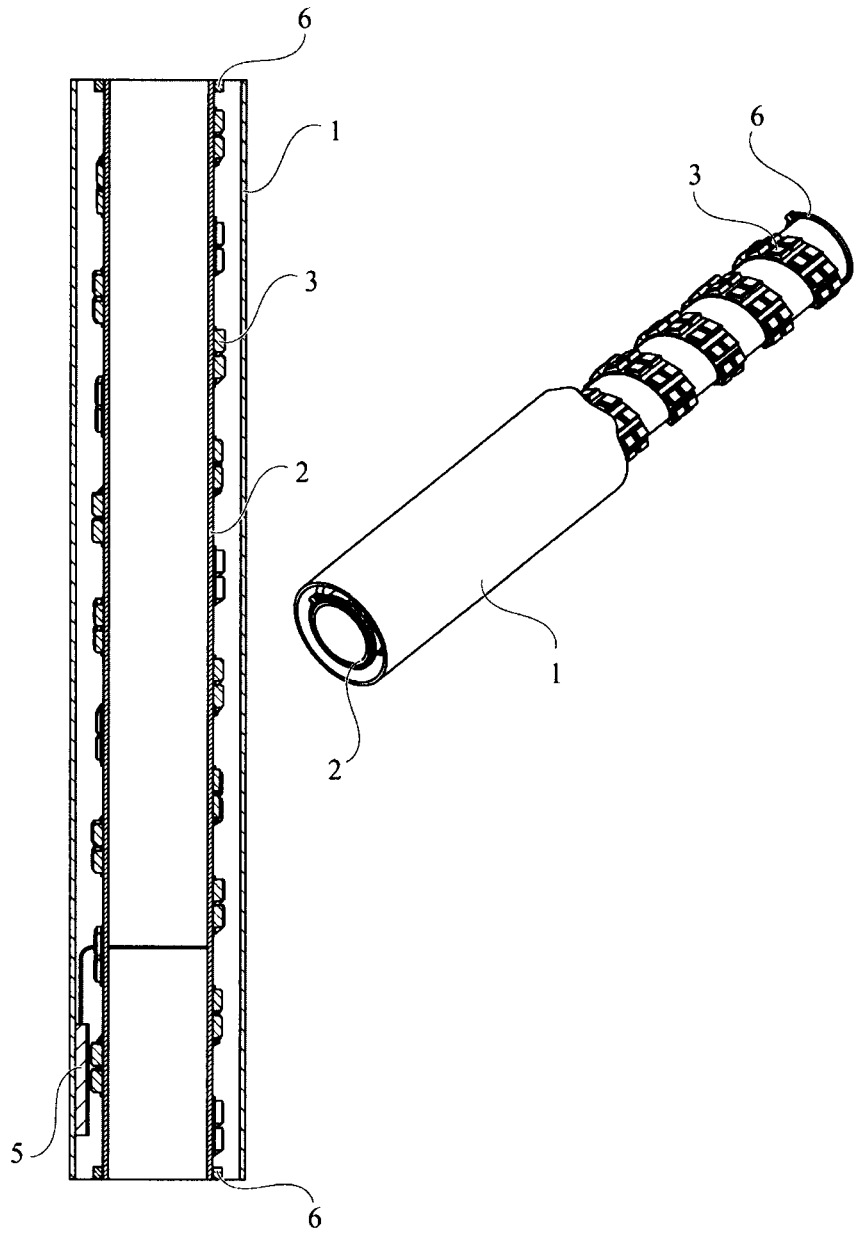
FIG. 2 shows one embodiment of the smart post comprising a structural body, a support body, a light-emitting device and a control unit, wherein the emitting device is a LED or ZIGZAG strip.

Referring to FIGS. 1 and 2, the light-emitting device (3) is located between the structural body (1) and the support body (2), wherein the light-emitting device (3) is supported by the support body (2). The support body (2) structurally strengthens the light-emitting device (3) and ensures that the device is maintained at a given distance from the structural body (1).

In one embodiment of the invention, the light-emitting device (3) is supported on the structural body (1) and the support body (2) is used to hold the electronic elements of the smart post.

Preferably, the structural body (1), the light-emitting device (3) and the support body (2) are layers that have no space between them. The aforesaid, in order not to lose quality in the visual signal displayed on the light-emitting device (3).

As mentioned above, the light-emitting device (3) is configured to display visual signals, said visual signals being controlled by the control unit (5). There may be more than one light-emitting device (3) in the smart post, this with the purpose that several visual signals may be displayed at the same time.

The light-emitting device (3) may be selected from the group consisting of light-emitting diodes (LED), organic light-emitting diode (OLED), laser diodes, cathode ray tube, liquid crystal display (LCD), plasma light, equivalent devices known to a person moderately skilled in the art and combinations thereof. In the preferred embodiment, the light-emitting device (3) is formed of LED diodes, the technical effects provided by LED diodes are as follows: lower energy consumption, good lifetime, high color rendering index, lower light pollution, less pollutants, higher resistance, variety of designs and colors.

In the case that the light-emitting device (3) is formed of LED diodes, these have many commercial presentations such as for example by arrays. The array of the LED diodes may be selected from the group consisting of LED arrays, LED or "ZIG ZAG" strips, equivalent presentations that are known to a person moderately skilled in the matter and combinations thereof.

Referring to FIG. 2, wherein the smart post comprises the light-emitting device as a strip of LEDs, which are spirally wound on the support body (2). The LED strip is attached to the support body (2) by means of fixing elements (6) at the ends of the LEDS strip.

LED diodes may be selected from the group consisting of DIP LED chip (traditional lights), SMD LED chip or surface mount device, COB LED chip (Chip on board), The light-emitting device (3) is arranged on at least a part of the external surface of the support body (2) by means of a fixing element (6). In one embodiment of the invention, the light-emitting device (3) covers the entire external surface of the support body (2), the foregoing has the purpose of setting the visual signals to be displayed in all possible directions.

The fixing element (6) may be screws, bands, clamps, welding, bands among others. Preferably, the fixing element (6) should allow the light-emitting device (3) to be changed in an easy and fast way.

Figure 3A:
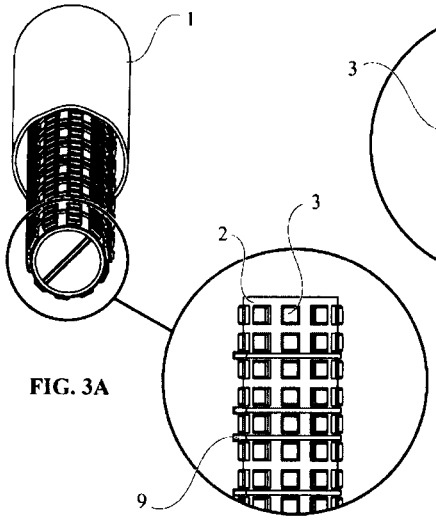
FIG. 3 shows an embodiment of a smart post comprising a structural body, a support body, and a light-emitting device, wherein the light-emitting device is held in the support body by bands.

Referring to FIG. 3A, the fixing elements are a plurality of bands (9) arranged horizontally around the light-emitting device (3), in this particular example of the present invention, the light-emitting device (3) is a LED array on the support body (2), fixing the light-emitting device (3) to the support body (2). The technical effect generated by the bands is that they allow the LEDs array to be easily removed in case of maintenance or when they need to be replaced.

Figure 3B:
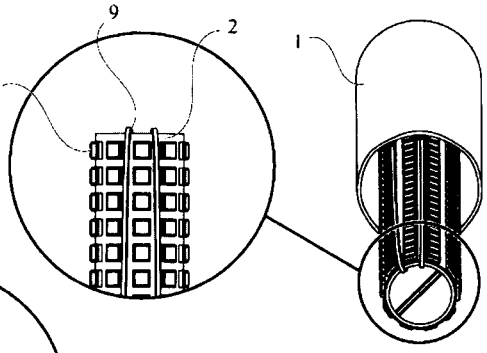

Referring to FIG. 3B, it is also shown that the fixing elements are a plurality of bands (9) vertically arranged.

In one invention embodiment, the support body (2) has holes along its length, said holes allowing the bands (9) to surround the support body (2), thereby supporting the light-emitting device (3) to the support body (2), the holes preventing the bands (9) from protruding from the support body (2). The holes may be equidistantly spaced.

The support body (2) may be provided with positioning fixtures coupled to the outer surface of the support body (2). One of the technical effects of such fixtures is to hold the light-emitting device (3) in a desired position.

The positioning fixtures optionally are plates with at least one perforation, each plate is arranged around the outer surface of the support body (2), and are located spaced apart from each other along the support body (2), wherein the outer surface of each plate or plate contour may be matched with the inner surface of the structural body (1). The spacing of the positioning fixtures depends on the size of the body, typically, the spacing distance of the positioning fixtures may be selected from a range between 30 cm to 300 cm. On the other hand, the type of materials of the positioning fixtures may be selected from transparent materials, translucent materials and/or opaque materials, preferably a transparent material is selected so the fixture does not affect the visual signal displayed by the light-emitting device (3).

The shape of the plate may be a geometric figure that may be selected from the group formed by circles, squares, triangles, rectangles, pentagons, trapezoids, ellipses, rhombuses, hexagon, heptagon, octagon, decagon, star, rhombus and any other geometric figure known to a person moderately skilled in the matter and combinations thereof. The plates may be composed by one or more pieces joined by a fixing mechanism (e.g., rivet, welding, interference fit, pressure fixing, thermal fixing, screws, bolts, pins, staples, cotter pins, among others), preferably interference fittings are used since they allow an easy coupling and uncoupling.

On the other hand, the perforations composing the positioning fixtures have different functions, the perforations mainly serve as support either for the support body (2) and/or for the light-emitting elements (3), however, they may also have other types of functions such as decreasing the weight of the positioning fixture. In the case where the positioning fixtures (18) are plates, the perforations may be located anywhere on the plate, either in the center of the plate, on its body or on its outer surface (e.g., sides). In case the plate geometric figure is a regular convex polygon (e.g., triangle, square, pentagon, hexagon, among others), the perforations may be located on the sides of the polygon and there may be more than one perforation per side.

Figure 4A:
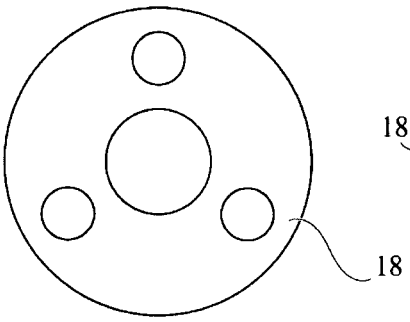
FIGS. 4A, 4B, 4C and 4D show a front view of two embodiments of positioning fixtures.
Figure 4B:
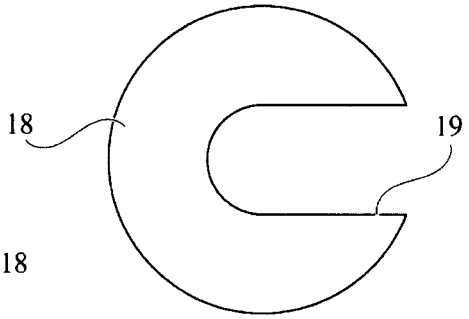
Figure 5:
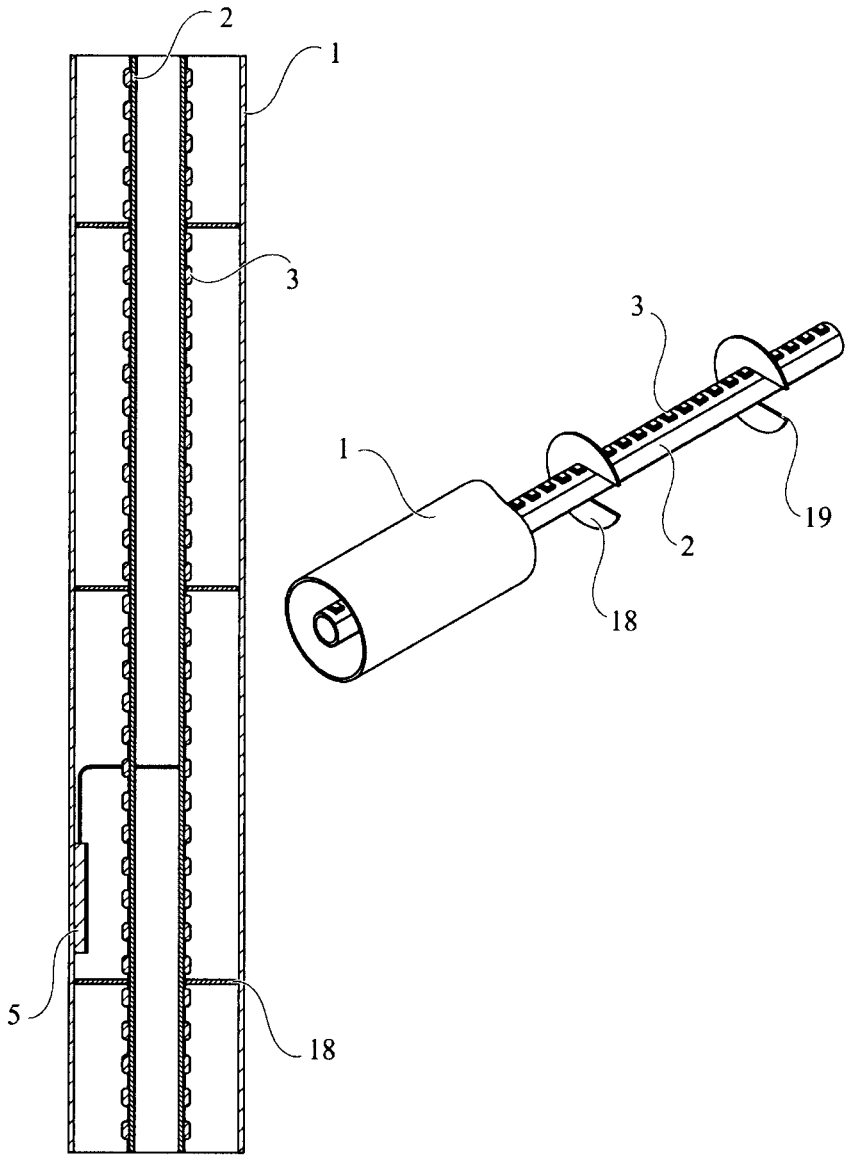
FIG. 5 shows an embodiment of the smart post comprising a structural body, a support body, a control unit, a light-emitting device and positioning fixtures, which are plates with a perforation, wherein the perforation is a slot.

Referring to FIGS. 4B and 5, the positioning fixtures (18) are circular plates with a perforation, which is a slot (19) running from the center of the plate to the outer surface of the plate. The slot (19) contains the light-emitting device (3) supported on the support body (2), in this case the slot (19) serves both to ensure that the light-emitting device (3) is maintained equidistant with respect to the inner surface of the structural body (1) along the smart post, and to facilitate maintenance of the light-emitting device (3).

When the positioning fixtures are plates with a perforation, which is a slot, the support body (2) and the light-emitting device (3) are fixed with removable fixing mechanisms (e.g., screws, clamps, rivets, bolts, pins, staples, cotter pins, adhesives, among others).

Figure 4C:
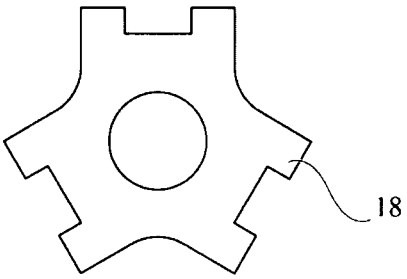

Referring to FIGS. 4A, 4B and 4C, the positioning fixtures (18) are circular plates with at least two perforations, wherein one perforation houses the support body (2) and the other houses the light-emitting device (3). A technical effect of this arrangement of the perforations is that it allows to give a specific position to the light-emitting device (3) closer to the structural body (1).

In the case of FIG. 4C, the positioning fixture (18) is a hexagonal shaped plate with seven perforations, one perforation on each side of the plate and the remaining perforation in the center of the plate in the form of a hole, with the six perforations being located on the sides of the plate. Of the six perforations, three perforations are rectangular slots, each located in the middle of each side, and wherein the other perforations are disposed on the sides contiguous to the sides where the rectangular slots are located, which are arcuate slots, wherein each of the arcuate slots go between the two vertices forming the side and are convex to the center perforation. In this particular embodiment the rectangular slots allow the housing of the light-emitting device (3) for example in the form of LED strips, on the other hand, the arcuate slots reduce the total material from which the positioning fixture (18) is made, thereby decreasing manufacturing costs.

Figure 6:
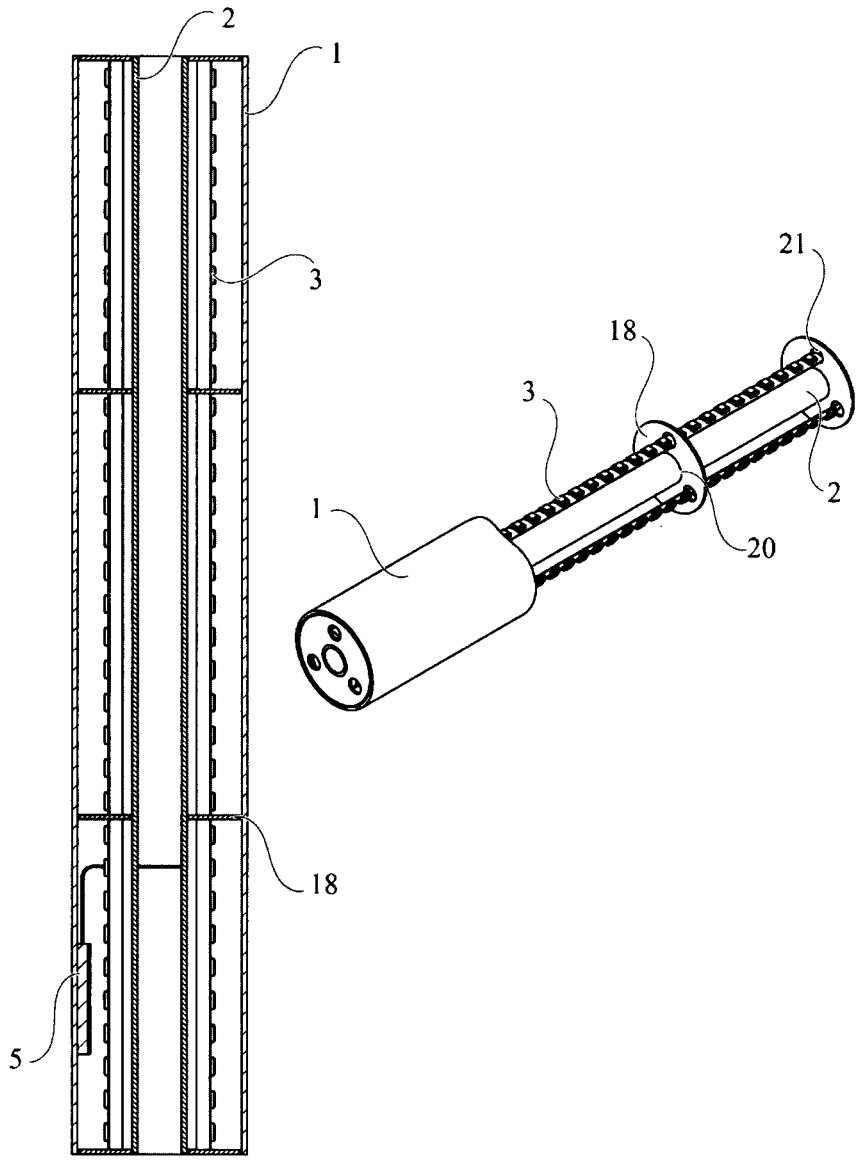
FIG. 6 shows an embodiment of the smart post comprising a structural body, a support body, a control unit, a light-emitting device and positioning fixtures, which are plates with four perforations, wherein the perforations are a central hole and three orbital holes.

Referring to FIGS. 4A and 6, the smart post has four positioning fixtures (18) which are circular plates, wherein the outer surface or plate contour of each plate adjusts to the inner surface of the structural body (1), each circular plate has four hole-shaped perforations, a central hole (20) and three orbital holes (21), the central holes (20) of each plate house the support body (2). On the other hand, the orbital holes (21) house three light-emitting devices (3) in the form of LED strips, the orbital holes (21) of each plate, are arranged in a manner that the light-emitting devices (3) in the form of LED strips are located parallel to the support body (2). As may be seen, the orbital holes (21) allow the LED strips to be closer to the structural body (1), which improves the quality of the visual signal displayed by the smart post.

Figure 4D:
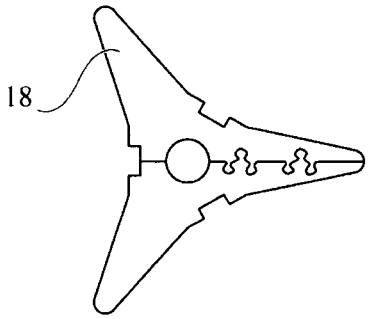

Referring to FIG. 4D, a positioning fixture (18) is shown which is a triangular plate with curved vertices, wherein the curved vertices adjust to the inner surface of the structural body (1). On the other hand, the triangular plate has seven perforations: two perforations on each side of the plate and the remaining perforation in the center of the plate in the form of a hole; of the six perforations that are located on the sides of the plate, three are square slots, the other three arcuate slots, specifically on each side there is a rectangular slot located in the middle of each of the sides and an arcuate slot, wherein each of the arcuate slots go between the two vertices that make up the side and they are convex to the center perforation. In this particular embodiment, the rectangular slots allow the housing of light-emitting devices (3) for example in the form of LED strips, on the other hand, the arched slots reduce the overall material from which the positioning fixture (18) is made, thereby decreasing manufacturing costs. Additionally, the plate consists of two parts that are coupled by interference fit.

On the other hand, the positioning fixtures are plates with at least two perforations, wherein the perforations of each plate may be arranged in a manner that the light-emitting device (3), for example in the form of LED strips, has an inclination with respect to the support body (2). The latter embodiment is used when the structural body (1) is truncated cone shaped and the support body (2) is straight, in which case the angle of the inclination corresponds to the angle of the truncated cone shape of the structural body (1). The angle of inclination may be selected from the range between 5° to 80°. A technical effect of presenting an inclination of the light-emitting device (3) is that it allows the distance between the light-emitting device (3) and the structural body (1) to remain the same along the smart post, thus maintaining the quality of the visual signal displayed.

Moreover, the positioning fixtures may be plates with a perforation, wherein the perforation of each plate houses the support body (2), said fixtures may be located along the support body, spaced therebetween (2). In this case, the outer surface of each plate or plate contour serves as a support for the light-emitting device (3) which may be for example in the form of a LED strip. One of the advantages of these fixtures is that they require less material to manufacture and are therefore less expensive.

In the case where the positioning fixture houses the support body (2) in a perforation, these may be coupled by a fixing mechanism (e.g., rivet, welding, pressure fixing, thermal fixing, screws, bolts, pins, clips, cotter pins, among others).

In one embodiment of the invention, the support body (2) may have different positioning fixtures, which may be categorized as primary positioning fixtures and secondary positioning fixtures.

Figure 7:
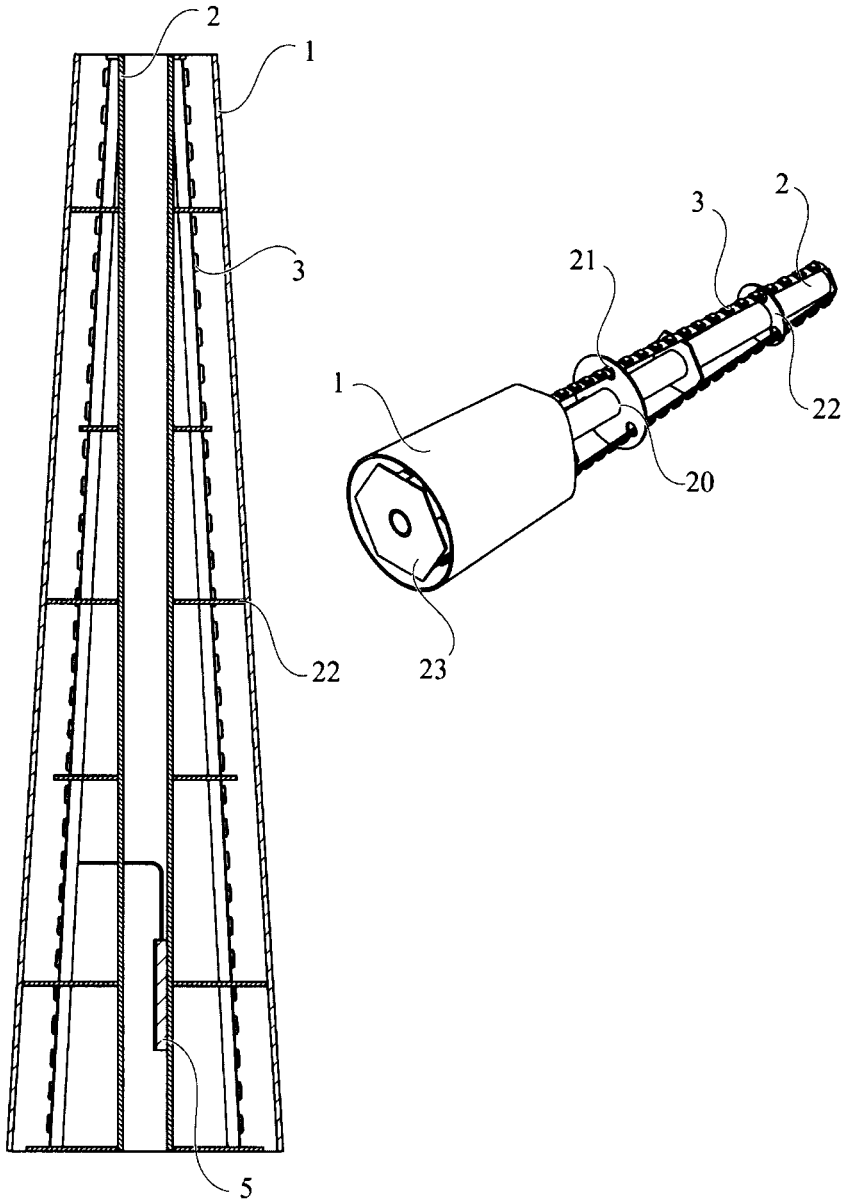
FIG. 7 shows an embodiment of the smart post comprising a structural body, a support body, a control unit, a light-emitting device and primary positioning fixtures, which are plates with four perforations, wherein the perforations are a central hole and three orbital holes. Additionally, the smart post has secondary fixtures which are hexagonal plates.

Referring to FIG. 7, the smart post has a truncated cone shaped structural body (1), it also has primary positioning fixtures (22) which are circular plates, wherein the outer surface (plate contour) of each plate adjusts to the inner surface of the structural body (1), i.e., each circular plate varies its radius along the support body (2). Additionally, the primary positioning fixtures (22) have four hole-shaped perforations, a central hole (20) and three orbital holes (21), the central holes (20) are located in the center of each circular plate and house the support body (2). On the other hand, the orbital holes (21) house three light-emitting devices (3) in the form of LED strips, the orbital holes (21) of each plate describe a circumference around the center of the circular plate and are equidistant. The radius of the circumference described by the orbital holes (21) of each plate varies, which allows the light-emitting devices (3) in the form of LED strips to have an inclination with respect to the support body (2). Additionally, the smart post has secondary positioning fixtures (23) which are hexagonal plates with a perforation which is a central hole, the central holes of each secondary positioning fixture housing the support body (2). In this fixture, light-emitting devices (3) in the form of LED strips are supported on the flat surfaces of the hexagonal plate.

Continuing with FIG. 7, the primary (22) and secondary (23) positioning fixtures are located along the support body (2), and arranged in an interspersed manner. As may be seen, the secondary positioning fixtures (23) in the form of hexagonal plates change their size along the support body (2). This is in order to keep the inclination formed by the light-emitting devices (3) in the form of LEDs, due to the secondary positioning fixtures (23).

In another embodiment of the invention, between two primary positioning fixtures, there is more than one secondary positioning fixture. This may be done to reduce the number of primary fixtures, as far as possible.

Figure 8:
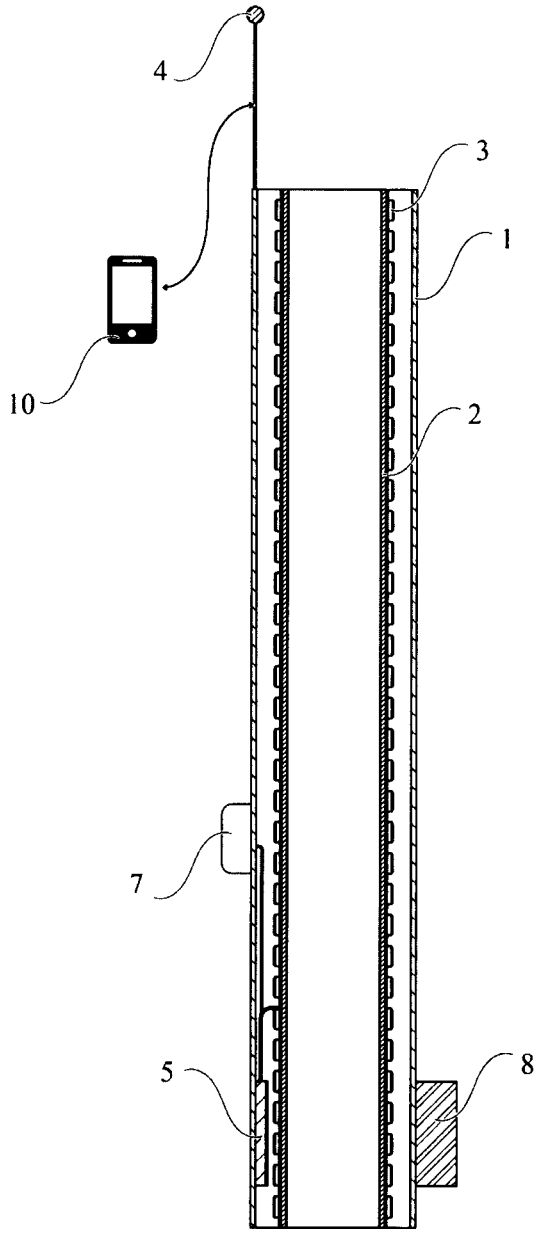
FIG. 8 shows an embodiment of a lighting post comprising a structural body, a support body, a light-emitting device, a communication module with an antenna, an external device and a control unit.

Referring to FIG. 8, the smart post of the present invention has at least one sensor (7) which is disposed in the structural body (1), wherein the sensor (7) is connected to the control unit (5). The use of said sensor allows optimizing the operation of the light-emitting device (3); in a specific example, the sensor (7) is a proximity sensor that detects the presence of people around the post, the control unit (5) based on the detection of people controls the light-emitting device (3) to display or not a visual signal. In this way, the smart post decreases the energy expenditure and extends the lifetime of the light-emitting device (3).

There is a variety of sensors (7) that may use the smart post, such sensor (7) may be selected from a group consisting of a proximity sensor, vibration sensor, environmental conditions sensor (e.g., temperature, humidity, dew point), pressure sensor, CO2 sensor, noise sensor, solar radiation sensor, wind speed sensor, sensors known to a person moderately skilled in the art and combinations thereof.

Moreover, in any of the embodiments of the smart post disclosed herein, the sensor (7) may be selected from the group consisting of proximity sensors, vibration, environmental condition sensors (e.g., temperature, humidity, dew point, wind speed, solar radiation, noise) pressure sensors, air quality sensors, particulate matter concentration (e.g., PST, Pm10, PM25) gas sensors (e.g., ozone, methane, sulfur, carbon monoxide, CO2, butane, smoke, alcohol, natural gas, flammable gases, benzene, ammonia, toluene, acetone, propane, formaldehyde, hydrogen), solar radiation sensors, wind speed sensors, seismic sensors, liquid level sensors and combinations thereof.

In case the smart post has sensors (7) of environmental conditions, these may measure useful variables for early warning systems for natural disasters, such as earthquakes, floods, volcanic activity, fires, typhoons, hurricanes, tornadoes, among others. For example, the control unit (5) of the smart post may communicate with an early warning management system or device, for example, through a network, either wired or wireless.

Also, the control unit (5) may take the signals coming from the sensors (7) to display through the activation of the light-emitting device (2) messages, data and symbols to alert people near the smart post about a natural disaster or emergency.

Now, specifically, the proximity sensors may be selected from the group formed by position switches, capacitive, inductive, photoelectric, ultrasonic, infrared, magnetic and equivalent sensors that are known to a person moderately skilled in the art and combinations thereof. In the preferred embodiment, the proximity sensor is an ultrasonic sensor and allows, in addition to detecting the presence of people, to establish the exact number of people and to send a value of both the people stopping and the number of people to the control unit (5).

The control unit (5) controls the visual signals displayed by the light-emitting device (3). The visual signals may be stored by default in the control unit (5), and it decides which visual signals to display with a control logic. Also, the visual signals may be generated due to signals sent by some sensor (7), for example, a temperature sensor (7) may send a signal indicating the ambient temperature, the control unit (5) receives this signal, processes it and converts it into a visual signal indicating the temperature as a text message, which is displayed by the light-emitting device (3). On the other hand, the visual signals may be sent by an external device associated with a user, captured by a communication module (4) that has an antenna, and this module is connected to the control unit (5). Considering the aforesaid, the control unit (5) may change the visual signal according to the needs of the moment, the external device may be another control unit other than the control unit (5).

For comprehension of the present invention, it should be understood that the control unit (5) is an electronic device processing data and it is selected among microcontrollers, microprocessors, DSCs (Digital Signal Controllers), FPGAs (Field Programmable Gate Arrays), CPLDs (Complex Programmable Logic Devices), ASICs (Application Specific Integrated Circuit), SoCs (System on Chip), PSoCs (Programmable System on Chip), PICs (Peripheral Interface Controller), computers, servers, tablets, cell phones, smart phones, signal generators and electronic devices known to a person moderately skilled in the field and combinations thereof. In a particular example, the control unit (5) is an AT91 SAM3X8E microcontroller.

Alternatively, the control unit (5) has a real-time clock or RTC, the RTC allows the control unit (5) to always have the current time. The RTC may be a device external to the control unit (5). The control unit (5) may send the RTC time to be displayed as a visual signal in the form of a text message on the light-emitting device (3).

Optionally, a logic level conversion interface is located between the control unit (5) and the light-emitting device (3). The interface allows electronic coupling between the control unit (5) and the light-emitting device (3), allowing the logic voltage and current levels of the control unit (5) to be converted to the voltage and current levels accepted by the light-emitting device (3).

For communication of the control unit (5) with any electronic element in the present invention, such as, for example, the light-emitting device (3), the sensor (7), an external RTC or an external control unit as mentioned above, in one example, said control unit (5) has embedded a communication module, which is selected from a wired communication module, a wireless communication module and a wired and wireless communication module.

For the comprehension of the present invention, it should be understood that a communication module is an electronic device that allows the sending and/or receiving of data between any electronic element of the present invention. In one example, the communication module is the bridge for a bidirectional communication between the control unit (5) and a remote-control unit (remote server).

In an example of the smart post, the wired communication module has a wired connection port allowing communication with external devices via a communication bus, which is selected from, among others, I2C (IIC Inter-Integrated Circuit), CAN (Controller Area Network), Ethernet, SPI (Serial Peripheral Interface), SCI (Serial Communication Interface), QSPI (Quad Serial Peripheral Interface), 1-Wire, D2B (Domestic Digital Bus), Profibus and others known to a person moderately skilled in the field.

In a particular example of the present invention, one of the devices external to the control unit (5) is an external RTC, the control unit (5) and the external RTC communicating over an I2C communication bus.

Figure 9:
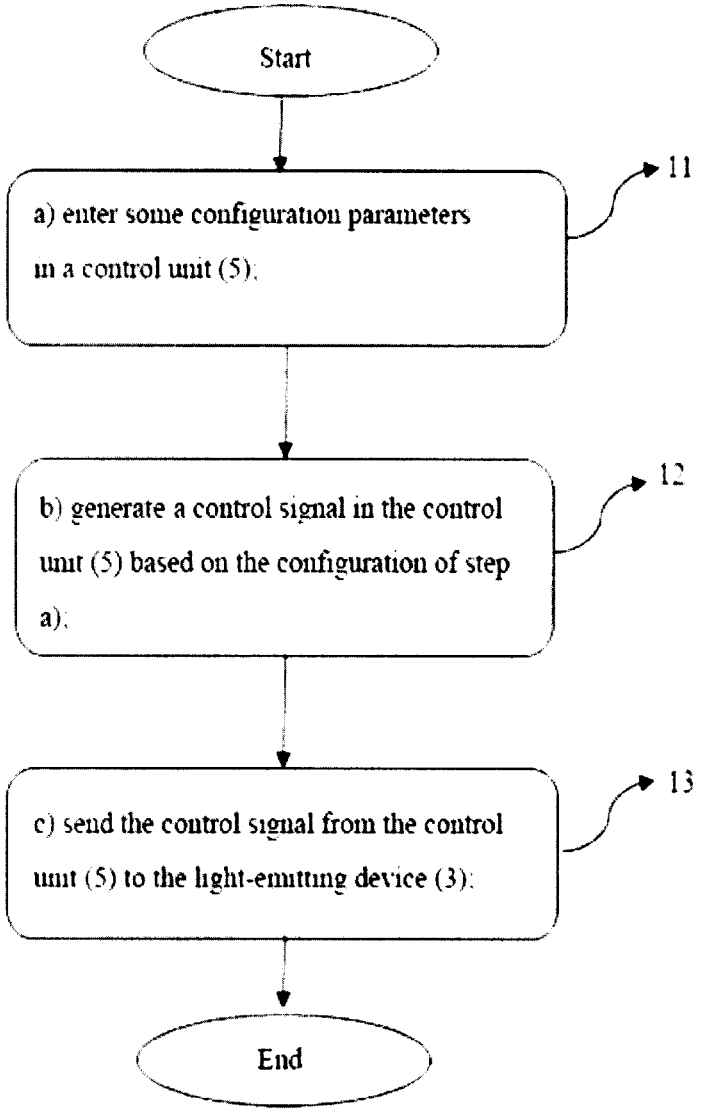
FIG. 9 shows a diagram of a method for controlling a smart post.

Alternatively and referring to FIG. 9, the communication module (4) is wireless with an antenna, said communication module implementing a wireless communication technology that is selected from the group consisting of Wi-Fi, Bluetooth, Zigbee, Radio Frequency, RF ID (for Radio Frequency Identification), UWB (Ultra Wide B-and), GPRS, Konnex or KNX, DMX (Digital MultipleX), Wi-Max and equivalent wireless communication technologies known to a person moderately skilled in the field and combinations thereof. Thus, an electronic element, e.g., the light-emitting device (3) may be connected wirelessly via the antenna of the wireless communication module (4) in the control unit (5), using a Wi-Fi wireless communication technology.

For example, the wireless communication technology may also be selected from among LIFI, ZigBee, LoRa/LoRaWan, communication protocols derived from 3G, 4G, 5G, GSM/GPRS, EDGE, other radio frequency or cell phone communication protocols, or other equivalent protocols or technologies.

In another example of the invention, the smart post has a wireless communication module (4) having an antenna, which is a Wi-Fi antenna, which enables communication between the control unit (5) and an external device (10), which in a particular example is a mobile device.

Additionally, the external device (10) may be connected via a web server to send data to the communication module, which then sends such information to the control unit (5).

For example, a mobile device may be connected to a web server to send a message to be displayed on the smart post, by means of the control unit (5).

In another example, the communication module is external to the control unit (5), in a particular example, the communication module is a slave of the control unit (5).

In one embodiment of the invention, a user by means of an external device communicates with the control unit (5) to, thereby, control the visual signals displayed by the light-emitting device (3). Communication between the external device and the control unit (5) may be given by means of the wireless communication module (4) having an antenna. Also, the control unit (5) may process information from the sensor (7) (e.g., environmental condition sensors), and then display it on the light-emitting device (3). Similarly, the control unit (5) may process the information from the sensor (7), and then send it to the external device (10). The external device (10) may be mobile (cell phone, tablet, laptop, among others) or may be fixed (e.g., computers).

The smart post has a power source that provides electrical fluid to the electronic elements of the present invention that need it, such as, for example, the light-emitting device (3), a sensor (7) and/or the control unit (5). On the other hand, each electronic element may have an individual power source.

The smart post may have its own power source or it may be connected to the street power, by any means (e.g., cables), or it may have both options. The advantage of having its own power source is that if there is a loss of power distribution in the sector, the lighting post will not affect the correct operation of the smart post, even if there is a loss of power distribution. In case the smart post is connected to the street energy and has electronic elements electrically compatible with direct current, the smart post must have an AC/DC converter.

Own energy sources may be selected from the group consisting of energy accumulators (e.g., batteries, rechargeable batteries are selected from the group of rechargeable lithium-ion batteries, e.g., LFP batteries, NMC batteries, Li—S batteries, LiPo batteries and other equivalent batteries known to a person moderately skilled in the field, lead acid batteries, advanced lead acid batteries, NiMH metal hydride batteries, nickel cadmium (NiCd) batteries, zinc bromide batteries, sodium nickel/chlorine NaNiCl batteries, zinc air batteries, vanadium redox batteries, other equivalent batteries known to a person reasonably skilled in the art, and combinations thereof), photovoltaic cells or solar panels, monocrystalline cells, polycrystalline cells, alternating current sources, direct current sources, internal combustion engines, wind generators, equivalent items known to a person reasonably skilled in the art and combinations thereof.

The smart post may have a solar generation system arranged on the cover of the structural body (1), the solar generation system comprising at least one photovoltaic cell, a solar tracker and an energy accumulator (e.g., battery). Wherein the solar tracker allows the photovoltaic cells to be oriented, so they remain approximately perpendicular to the sun rays, following the sun from east at sunrise to west at sunset. The solar tracker may be selected from the group consisting of a two-axis mono-post solar tracker, a two-axis carousel solar tracker, a single polar axis solar tracker, a single azimuthal axis solar tracker, a single horizontal axis solar tracker, solar trackers known to a person reasonably skilled in the art, and combinations thereof.

In another embodiment of the invention, the smart post has its own energy source which is a flexible photovoltaic cell, wherein said cell is molded to form an arc and it is disposed on the structural body (1) by fixing means (e.g., screws, bolts, welding, clamps, among others). In another embodiment of the invention, the flexible photovoltaic cell and the structural body (1) form a monolithic body.

The smart post may have arranged in the structural body (1) an AC outlet connected to the power source of the smart post, which may be the smart post own power source or to street power.

Referring to FIG. 8, the smart post of the present invention comprises a USB port (8) which is disposed on the structural body (1). The USB port (8) may be connected to the control unit (5), whereby a user by means of the USB port (8) may extract information from the control unit (5), such as the total number of people approaching the smart post, or daily environmental conditions data. On the other hand, the control unit (5) may have a charging module, which allows the USB port (8) to be used to charge any electronic device people may have around, this leads people to approach and charge the electronic device and observe the visual signal shown by the light-emitting device (3).

In one embodiment of the invention, the USB port (8) has a power source of its own, whereby the USB port (8) only serves to charge any electronic device.

The smart post may have a sound device, which allows to create a visual signal in the form of a light pattern that varies according to sound frequencies such as music, i.e., the colors in which the light pattern is displayed vary according to the frequency of the sound being played at that moment. The sound device sends audio signals to the control unit (5), which should include an audio circuit, said circuit captures and processes the audio signal to, then, control how the visual signal is displayed on the light-emitting device (3). In one embodiment of the invention, the audio circuit is an independent control unit, which is a slave of the control unit (5), in this case the control unit with the audio circuit receives and processes the audio signal and, subsequently, sends a processed signal to the control unit (5), which then controls how the message is displayed on the light-emitting device (3).

Referring to FIG. 9, the present invention also relates to a method for programming a smart post, comprising the following steps:

a) entering some configuration parameters (11) in a control unit (5);

b) generating a control signal (12) in the control unit (5) based on the configuration of step a);

c) sending the control signal (13) from the control unit (5) to the light-emitting device (3);

wherein the control signal of stage c) controls the light-emitting device (3) to emit visual signals;

wherein the visual signal may be text messages, images or light patterns.

Wherein the configuration parameter may be information related to the characteristics of the light-emitting device (3) in stage a), such as array size, frequency, flash, among others, so that the control unit (5) may configure how it will display the visual signals.

Additionally, within the configuration parameters a predetermined visual signal must be entered, which will be displayed by the light-emitting device (3). The configuration parameters may be entered into the control unit (5) in step a) by means of, for example, keyboards, TFT (Thin Film Transistor) touch devices, a peripheral, such as a personal computer (PC) connected wirelessly or wired through the USB port (8) external or internal to the control unit (5), or the external device (10).

In stage b), in the case where the light-emitting device (3) is a set of LEDs, the configuration parameters may be specifying the size of the LED array N×M, the shape of the LEDs, how the LEDs are connected, the color filter mosaic that the LEDs handle (e.g., RGB Bayer Filter, RGBE Filter, CYYM Filter, CYGM Filter, RGBW Bayer Filter, RGBW Filter #1, RGBW Filter #2, RGBW Filter #3, among others), among other characteristics, so the control unit (5) may send the control signal in a way that the light-emitting device (3) will correctly display the visual signal.

Also, configuration parameters may include LED brightness level (e.g., 0 for dark and 255 for bright), signal inversion, LED channel, DMA channel selection to generate a signal, PIN selection, LED light emission frequency, and combinations thereof.

In step c) a visual signal may be a text message indicating the date and time, in case the control unit (5) has an associated RTC.

The user may configure the control unit (5) to control the light-emitting device (3) by always displaying a visual signal. On the other hand, the user may configure a time to display the visual signal or visual signals, i.e., that only the visual signal will be displayed under a condition, where the time in which the message is displayed is called information time, this time will vary according to the application needs. The conditions under which the visual signal is displayed vary according to the needs, one condition may be a timeout set by the user, i.e., the visual signal is displayed for predetermined periods of time, i.e., intermittently. On the other hand, another condition may be the presence of people around the smart post. In the case where several visual signals are to be displayed on the light-emitting device (3), the user in the configuration stage may define whether all visual signals are displayed at once or whether they are displayed sequentially. Also, the control unit (5) may make the decision to display all visual signals at the same time or not, based on the size of the light-emitting device (3).

If the user or the control unit (5) decides to display the visual signals sequentially, each visual signal is distributed within the total information time, i.e., each visual signal is displayed in a shorter time than the total information time, the time to display each message may vary, for example, between 0 to 20 seconds. Displaying the visual signals sequentially, in the case of text messages, has the advantage that the person may read each text message more easily, because the letters are larger, which facilitates understanding. For example, the control unit (5) sends to the emitting device (3) first a predetermined visual signal in the form of a text message (e.g., "Hello") to be displayed for 20 seconds and after 20 seconds the control unit (5) sends another visual signal in the form of a text message with the date and time to be displayed by the light-emitting device (3) for 6 seconds, in this example the information time is 26 seconds.

Figure 10:
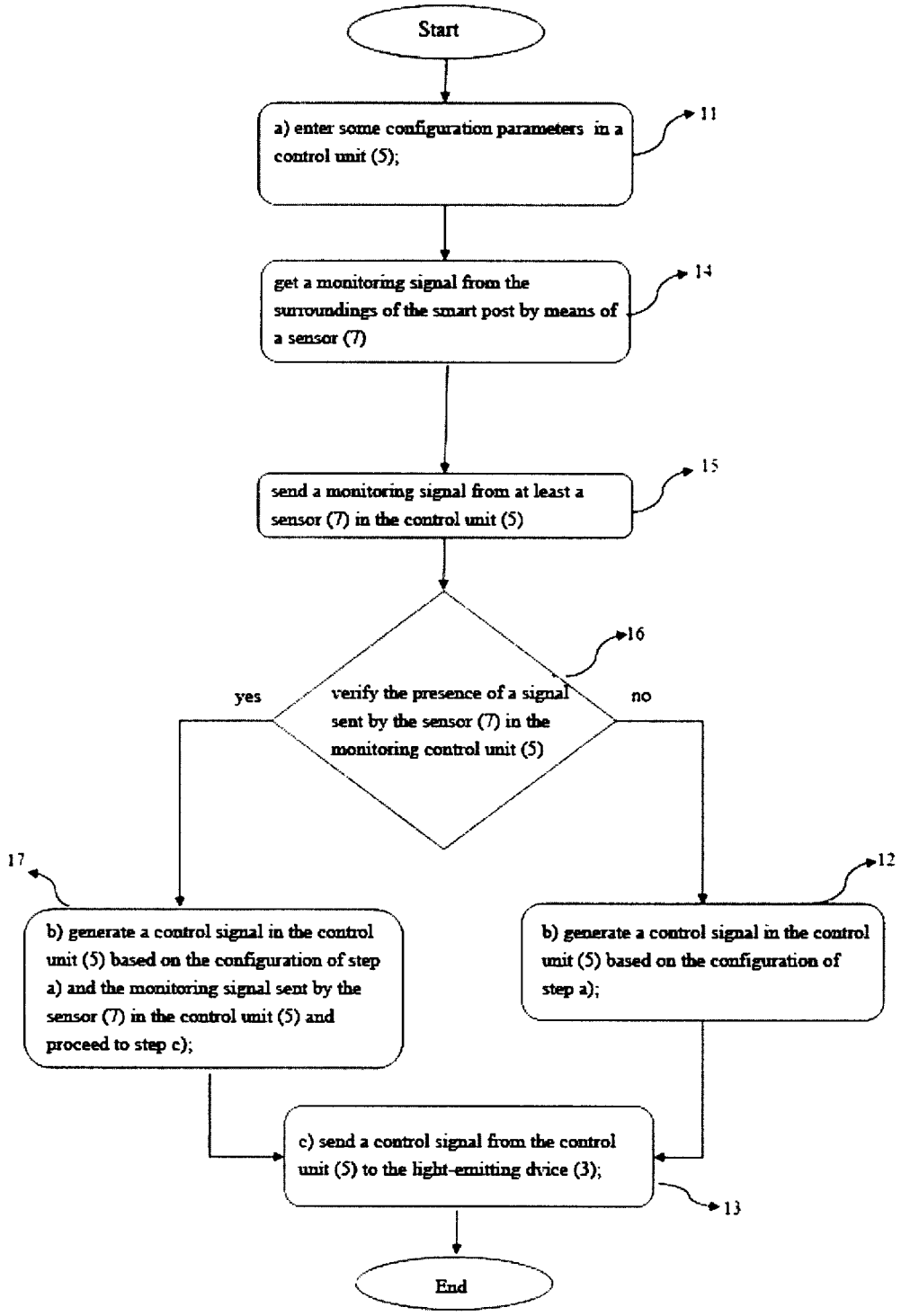
FIG. 10 shows a diagram of a method for controlling a smart post, wherein the smart post has at least one sensor.

Referring to FIG. 10, in the case where the smart post has at least one sensor (7), some sub-stages are added to the method after the configuration parameter entry stage (11), since these sub-stages correspond to a sensor monitoring (7), the sub-stages are as follows:

- obtaining a monitoring signal from the surroundings of the smart post (14) by means of a sensor (7);
- sending the monitoring signal (15) from the sensor (7) to the control unit (5);
- verifying the monitoring signal (16) sent by the sensor (7) in the control unit (5), following the conditions below:
  - if the monitoring signal is not detected, a control signal (12) is generated in the control unit (5) based on the settings of step a) and proceeds to step c);
  - if the monitoring signal is detected, a control signal (17) is generated in the control unit (5) based on the settings of stage a) and the monitoring signal sent by the sensor (7) in the control unit (5) and proceeds to stage c).

For the comprehension of the present invention, it should be understood that the control unit (5) considers the configuration parameters entered in stage a), when generating the control signal (17 and it also considers the monitoring signal sent by a sensor (7), in case the smart post has at least one sensor (7).

In one embodiment of the invention, the smart post sensor (7) is a proximity sensor, wherein said proximity sensor sends information about the presence or not of people around the smart post and also defines how many people there are in its detection angle. In one embodiment of the invention, the smart post has a ring of detection sensors (7), thereby allowing detection of all people around the post.

With the presence of the detection sensor, the following stages are added to the method between the stage where the configuration parameters are entered (11) and the stage where the control signal is generated (17):

- monitoring the surroundings until a person within the detection distance is detected by the sensor (7);
- generating a monitoring signal according to the monitoring stage;
- sending the monitoring signal from at least one sensor (7) to the control unit (5);
- verifying the monitoring signal sent by the sensor (7) in the control unit (5), according to the following conditions:
  - if the monitoring signal is not detected, a control signal (12) is generated in the control unit (5) based on the settings of step a) and proceeds to step c);
  - if the monitoring signal is detected, a control signal (17 is generated in the control unit (5) based on the settings of stage a) and the monitoring signal sent by the sensor (7) in the control unit (5) and proceeds to stage c).

Wherein, a sensing distance of the proximity sensor (7) is defined, in one embodiment of the invention prior to monitoring the proximity sensor (7). The foregoing may be done in parallel with step a).

Once the control unit (5) processes the monitoring signal from the proximity sensor, the control unit (5) generates a control signal (17 and controls the light-emitting device (3) to display a visual signal based on the information from the proximity sensor, which in this case may be in the form of a text message such as "hello". Also, it is important to clarify when no monitoring signal is detected, which may mean that there is no presence of people in the vicinity or that the proximity sensor presents some failure, the control unit (5) may send a control signal (13) that controls the light-emitting device (3) to disconnect from its power source, whether its own or not, with the purpose of saving energy and increasing the useful life. On the other hand, in the event that the proximity sensor does not detect people, the control unit (5) may send a control signal (13) to control the light-emitting device (3) and display a visual signal to motivate people's approach.

Figure 13:
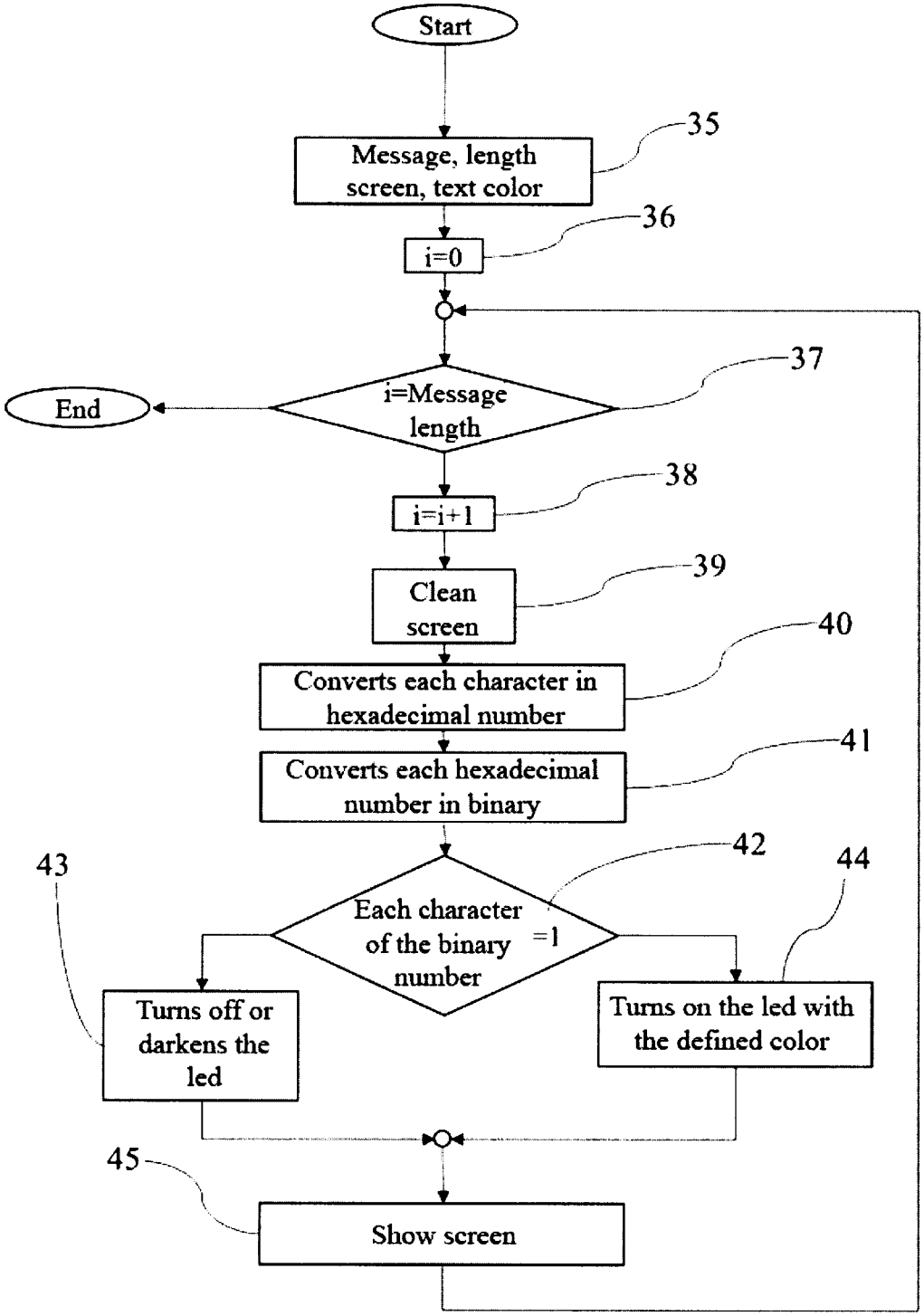
FIG. 13 shows a flow diagram of one embodiment of a method for transforming characters in a message, such as letters, numbers and symbols, into binary numbers that configure an on/off sequence of LEDs or lighting means of a transmitting device. The method converts each character of the message into a hexadecimal number, which is subsequently converted into a binary number.

In another embodiment, the proximity sensor detects people approaching the smart post, in order to be counted, then, by means of the control unit (5), each time the control unit (5) detects a monitoring signal, it increases a people counter (Person). In this case, the control unit (5) must verify the following conditions:

- if the information time is greater than or equal to a value set in the control unit (5) then a control signal (13) is generated, so in stage c) said signal controls the light-emitting device (3) to emit a visual signal in the form of a text message, including the number of people around the smart post;
- if, on the other hand, the information time is not greater than a value set in the control unit (5) then a control signal (17 is generated, so in stage c) said signal controls the light-emitting device (3) to emit a visual signal in the form of a text message with a welcome message;

Referring to FIG. 13, in one embodiment of the method in the present invention, the control unit (5) executes a method for transforming characters of a message, such as letters, numbers and symbols, into binary numbers that configure an on and off sequence of LEDs or lighting means of a light-emitting device (3), which may be formed by one or more LED strips, or by lighting means such as pixels, bulbs, LEDs, or other equivalent illumination means. The method first converts each character of the message into a hexadecimal number, which is subsequently converted into a binary number.

Now, the light-emitting device (3) may be any device that allows to selectively activate and deactivate lighting means, such as LEDs, pixels or other analog, digital or virtual elements that are equivalent.

One of the technical effects of first converting each character into a hexadecimal number and then into a binary number is that it facilitates the creation of data tables, which use the hexadecimal numbers so they contain abbreviated character information allowing easy identification by a user. The hexadecimal number data tables may be stored in a database. The database may be located in a memory of the control unit (5), or they may be stored in a remote database, such as a server in a cloud that communicates with the control unit (5) via a communication protocol and a communication network.

Another effect of first converting each character into a hexadecimal number and then into a binary number is that a user may manually program each character, which may be a custom symbol, from one or more hexadecimal numbers. This reduces typing and programming mistakes, and facilitates code review and debugging, compared to the case where the user must program the characters directly into sequences of binary numbers.

Referring to FIG. 13, the method may have the following stages:

executing a first stage (35) wherein a plurality of configuration parameters (11) is entered, wherein one of the configuration parameters (11) is the characters of a message, and a display length of the light-emitting device (3);

executing in a second stage (36) the initialization of a value counter (i) defining an activation of some activation zones (46) of the light-emitting device (3), wherein each activation zone (46) corresponds to an area of the light-emitting device (3) display;

executing in a third stage (37) a conditional wherein:

if all characters of the message were displayed at least in one activation zone (46) of the light-emitting device display (3), then the method is terminated, otherwise it proceeds to a fourth stage (38);

executing the fourth stage (38) wherein the counter of the second stage (36) is increased by a value, wherein the increase of the counter is visually translated into a movement of the characters displayed on the screen from a first end where an activation zone (46) with a minimum value (i) is located towards a second end of the screen with a maximum value (i);

executing a fifth stage (39) in which the light-emitting device screen (3) is cleaned (3);

executing a sixth stage (40) in which each character of the message in the first stage (35) is converted to a hexadecimal number;

executing a seventh stage (41) in which each hexadecimal number of the sixth stage (40) is converted into a binary number;

executing an eighth stage (42) in which each binary number is associated with an activation and deactivation/darkening sequence of some lighting means, LEDs, or pixels of the light-emitting device (3) display; wherein turning on the lighting means a tenth stage (44) is executed, and in order to turn off or darken the lighting means a ninth stage (43) is executed;

executing a ninth stage (45) in which one or more characters of the message are displayed on the activation zones (46) of the display; and the third stage conditional (37) is executed again until all characters of the message were displayed at least in one activation zone (46) of the light-emitting device (3) display.

In the first stage (35), configuration parameters (11) related to a message are selected, which may be message length, available length of the light-emitting device (3) (e.g., length of the LED strip or display dimensions), text color, display time of the character in an activation zone (46) and combinations thereof.

In the second stage (36) a counter is initialized to perform a displacement of the message characters from a first end of the light-emitting device (3) to a second end thereof. For example, in FIG. 13 a value (i) is assigned for each zone of the light-emitting device (3) so as the value (i) increases, this corresponds to a different zone of the light-emitting device (3).

Figure 14:
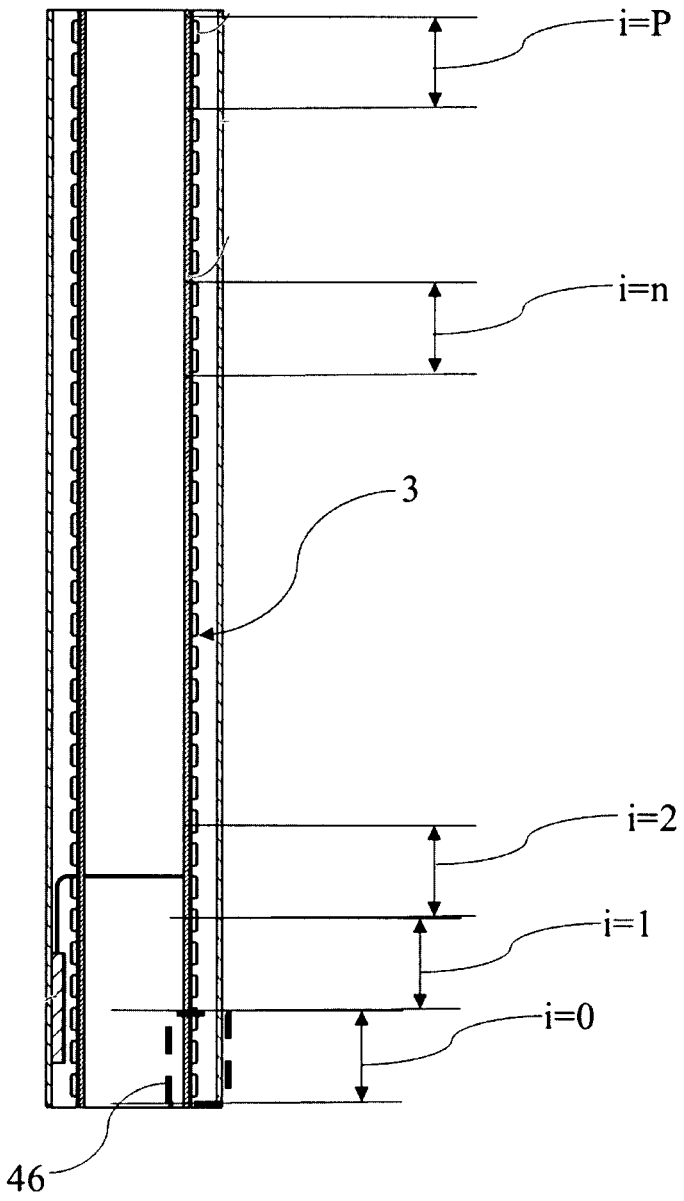
FIG. 14 shows an embodiment of the smart post, wherein an activation zone of a light-emitting device embodiment is shown.

For example, referring to FIG. 14, in one embodiment of the smart post, the smart post has a light-emitting device (3) that displays messages from a lower point near the ground to an upper point away from the ground. In this case, the value i=0 may represent an activation zone (46) of the light-emitting device (3) close to the ground.

The activation zone (46) may be a region comprising a pixel frame of a display, or a group of LEDs. Furthermore, the activation zone (46) may be configured to fully display at least one character.

Accordingly, as the value (i) increases, this translates into a change in the height of the activation zones (46).

For example, in one embodiment of the smart post, each activation zone (46) has a height between 3 cm and 15 cm. Therefore, if the value (i) increases to i=1, a character would be displayed on an activation zone (46) located at a height between 6 cm and 30 cm measured from an edge of the light-emitting device (3).

For its part, the third stage (37) corresponds to a first conditional enabling data flow between the control unit (5) towards the light-emitting device (3), wherein the data flow enables displaying and moving characters from a first end of the light-emitting device (3) towards a second end of the light-emitting device.

In the fourth stage (38) the value (i) is increased by a value of one unit in order to shift the character, or group of characters displayed on the activation zones (46) of the light-emitting device (3).

In the fifth stage (39) the screen is cleaned, i.e., all pixels or LEDs of the light-emitting device (3), or the lighting means with the said light-emitting device (3), are dimmed or switched off, In the sixth stage (40), the control unit (5) converts each character of the message into a hexadecimal number, and then, in a seventh stage (41) it converts the hexadecimal number into a binary number.

Subsequently, in the eighth stage (42), the control unit (5) executes a conditional wherein it considers the binary numbers to send an activation signal to certain LEDs, pixels or lighting means of the light-emitting device (3), so that the LEDs or lighting means are illuminated to display the message in such a way that a person may identify and read the message when looking at the light-emitting device (3).

When the activation signal of the ninth stage (42) corresponds to the turning on of one or more LEDs in colors other than black, this corresponds to the execution of the ninth stage (42) as depicted in FIG. 13. On the contrary, if the activation signal of the ninth stage (42) corresponds to the turning off and dimming of the LEDs (emission of black or a similar color), this corresponds to the execution of the tenth stage (43) as depicted in FIG. 13.

Also, at this stage, the color with which the light-emitting device (3) displays the characters of the message that was selected in the first stage (35) is selected.

In addition, the method has the ninth stage (45) which consists of displaying on the light-emitting device (3) the characters of the message, displacing the characters from a first end to a second end of the light-emitting device (3) taking into account the configuration parameters (11) selected in the first stage (35). At the end of the ninth stage (45), the method returns to the third stage (37) to execute again the fourth stage (38) wherein the value (i) is increased, thereby generating a displacement of the message in the light-emitting device (3).

The method ends when the conditional of the third stage (37) identifies that the value (i) has reached a predefined value corresponding to the message length.

For example, referring to FIG. 14, in one embodiment of the smart post the message is displayed from i=0, to i=P. The message visually displaces up the smart post. When the message begins to be displayed, the first character of the message is displayed on the activation region (46) corresponding to the value i=0 for a predetermined time, for example, between 0.3 s and 2 s. Then, when the value (i) increases in the method, this results in a vertical displacement of the characters upwards.

EXAMPLES

Example 1

The smart post is designed to be supported on a base plate; the specific features of the smart post are as follows:

The structural body (1) has a truncated cone shape and it is made of glass fiber reinforced polyester (GRP), the structural body (1) has a thickness of 4 mm and a length of 5 m, with a breaking load of 150 or 300 kgf. Internally, there is the support body (2) which is a tube formed by two pieces joined by an adhesive, the tube has holes along its length. Additionally, the smart post is supported by means of bands (9) arranged vertically around the support body (2), wherein said bands (9) keep the light-emitting device (3) supported to the support body (2), in this case the bands (9) are inserted through the holes of the support body (2) to improve the aesthetics of the smart post. The control unit (5) is an ATMega2560 microcontroller, with a DS3231 RTC with I2C port. Also, the smart post has an AM2302 temperature sensor that measures a temperature between −40° C. (degrees Celsius) to 80° C.

Figure 11:
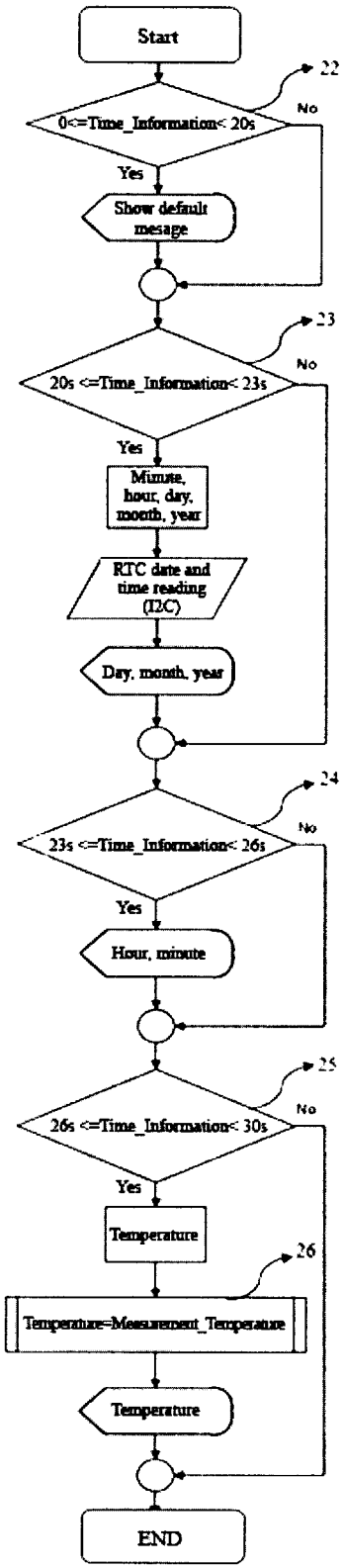
FIG. 11 shows a diagram of a method for controlling a smart post, wherein the smart post displays different visual signals.

Referring to FIG. 11, in this case the control unit (5) was configured so the light-emitting device (3) displays sequentially visual signals in the form of text messages, the information time is 30 seconds to display four visual signals in the form of text messages.

Continuing in FIG. 11, the text messages displayed are distributed as follows: The first text message ranges from 0 to 20 seconds (22) where a default message is displayed, in this case "Hello". The second message goes from 20 to 23 seconds (23), this message shows the exact date on which the message is displayed Day, Month and Year. The third message goes from 23 to 26 seconds (24), in this third message the exact time Hour, Minute will be shown. The last message goes from 26 to 30 seconds (24) and shows the temperature of the moment in the place where the smart post is located, for example "24° C.".

In another aspect, the present invention includes a lighting system comprising a first smart post and a second smart post, wherein each smart post is a smart post as any of those described heretofore.

In the lighting system, the control unit (5) of the first smart post is configured as a master processor and the control unit (5) of the second smart post is configured as a slave processor, depending on the control unit (5) of the first smart post.

In multiple invention embodiments one may have a plurality of second smart posts having their control units (5) configured as slave processors that depend on the control unit (5) of the first smart post.

It will be understood in the present invention that the second posts are smart posts characterized in that their control unit (5) is configured as a slave processor, which depends on a control unit (5) of a first smart post, which is configured as a master processor.

The second smart posts may be equal to each other, i.e., have similar or equal technical characteristics (e.g., geometry and/or material of the support body (2), type of light-emitting device (3), type of the control unit hardware (5), fixing elements (6), positioning fixtures (18), slots (19), sensors (7), among others). Moreover, the first smart post may be the same as the second smart posts.

In the same manner, in any of the lighting system embodiments, the first smart post and the second smart posts may be different from each other, e.g., have a different support body geometry (2), have different control unit hardware (5), include different types of sensors (7), or have their light-emitting devices (3) comprise different types of lighting means, varying in shape, size, or resolution, where resolution relates to the number of pixels, LEDs, or other lighting elements that make up a display of the light-emitting device (3).

The lighting system consisting of the first smart post, and one or more second lighting posts, allows to execute lighting controls, displaying information and communication parameters, among other applications.

For example, the control unit (5) of the first smart post configured as a master processor may command the control units (5) configured as a slave processor to repeat a sequence of commands related to measuring, processing, and displaying information on their respective light-emitting devices (3).

Example 2

Figure 12:
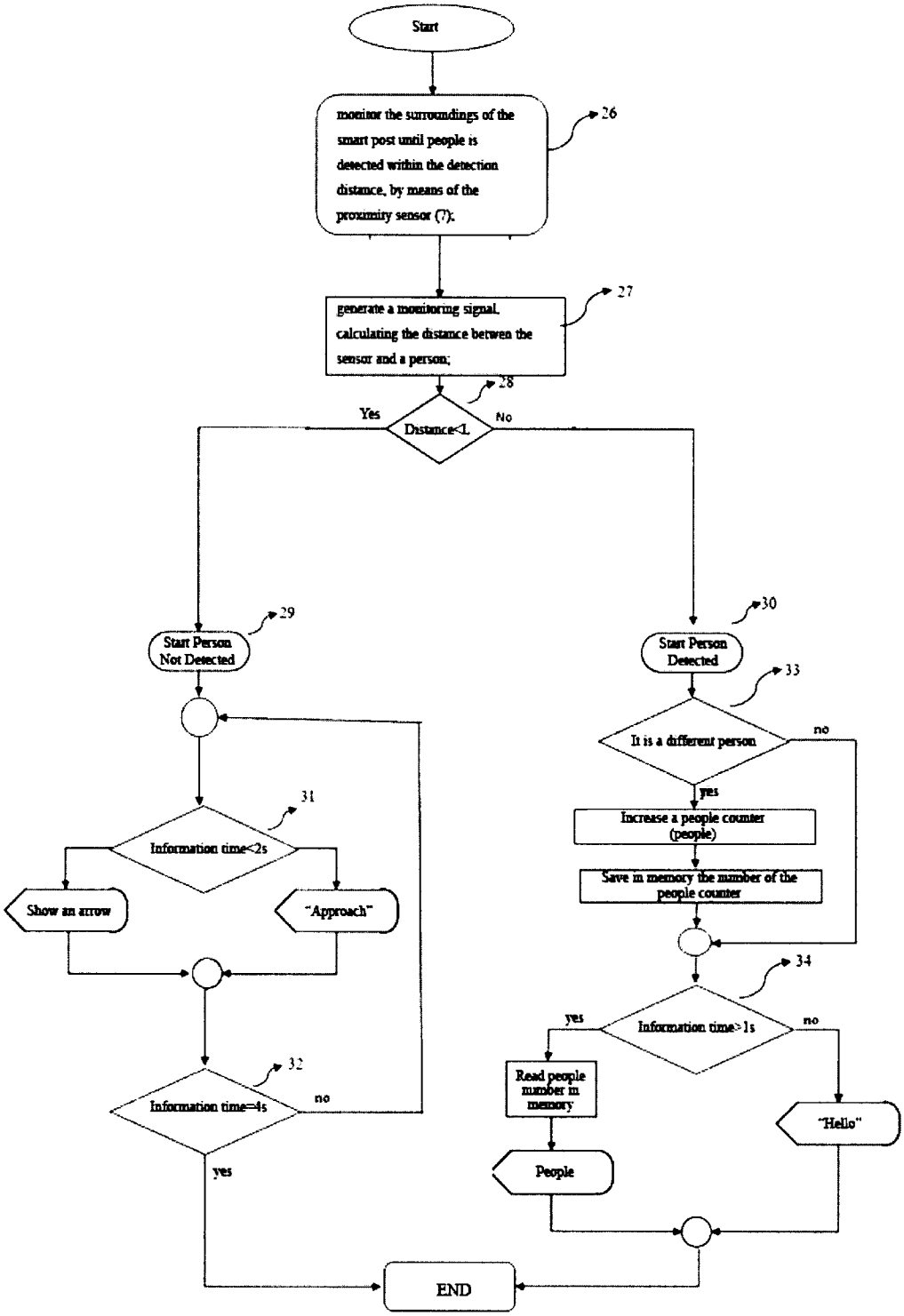
FIG. 12 shows a diagram of a method for detecting people around the smart post by means of a proximity sensor.

In a second test the smart post of the previous example was added with a proximity sensor Jsn-sr04t with a range for detection of people between 20 cm and 450 cm and a second light-emitting device (3), where it shows exclusively the information of the proximity sensor. For this test the control unit (5) was configured as follows:

Referring to FIG. 12, the proximity sensor (7) monitors the surroundings of the smart post (26), previously the control unit (5) was defined with a sensing distance of 160 cm. In this particular example, the particular proximity sensor generates the monitoring signal by calculating the distance between a person (27), alternately emitting and receiving ultrasonic waves, and then using the following formula: Distance=½×T×C, where T is the time between emission and reception, and C is the speed of sound.

Continuing with FIG. 12, with the presence of the proximity sensor, there are two conditions that are the presence of people or not, in this test for each condition different visual signals were prepared. In this case, the control unit (5) defines no presence of people (29) when the distance L is less than the detection distance (28), which in this particular case is 160 cm, otherwise it is understood that it did not detect a person (29).

Referring to FIG. 12, for the condition of no presence of people around the smart post (29) an information time of 4 seconds (32) was configured, where two visual signals were shown, one in the form of an image and the other in the form of a text message, from time 0 to 2 seconds (31) the image is shown which is an arrow pointing to the floor. Within 2 to 4 seconds (32), the text message "Approach" is displayed Continuing with FIG. 12, in the condition of presence of people around the smart post (30), first, the control unit (5) determines whether the person is still the same or is new (33). It is considered that the person is not the same when the sensor (7) stops sending a monitoring signal and after a while sends another one, that flank determines the presence of a new person. In case the person is new, it increases a people counter and the number is recorded in the memory register. Then, in case the person is new the control unit (5) is configured to display two visual signals in the form of text messages, the first text message is "Hello" after the first second (34). After the first second a text message is displayed with the number of people, which are in the memory register, who have passed by the smart post. The message "5 people" is displayed until there are no people around the smart post.

Example 3

A Python code, configured to convert a message with characters such as letters, numbers or symbols into binary numbers, was programmed and implemented in a control unit (5) of a smart post embodiment. The method comprises a fifth stage (40) consisting of converting each character into a hexadecimal number, and subsequently, in a sixth stage (41) converting each decimal number into a binary number. The binary number sequences allow turning on and off or dimming some LEDs of a light-emitting device (3). In the present example the light-emitting device (3) is made up of LED strips.

The Python code for the method of this example is shown below:

Message example code of the led array

First, the first stage (35) was programmed, in which configuration parameters (11) were defined, such as the length of each LED strip, and the number of LED strips that make up one embodiment of the light-emitting device (3) display, the PIN of the LEDs, their operating frequency, brightness level, signal inversion and DMA channel parameters. The colors with which the LEDs are illuminated are also defined, and the time in which a character is displayed on each activation zone (46). A fragment of the code corresponding to this first stage is shown below (35):

```
# Configuration parameters
Length = 60 # Length of each LED strip Number = 5 # Number of
LED strips
LED_COUNT = Length*Number # Number of LED pixels.
LED_PIN = 12 # GPIO pin connected to the pixels (must support
PWM!).
LED_FREQ_HZ = 800000 # LED signal frequency in hertz
(usually 800khz)
LED_DMA = 10 # DMA channel to use for generating signal (try 10)
LED_BRIGHTNESS = 255 # Set to 0 for darkest and 255 for
brightest LED_INVERT = False # True to invert the signal
(when using NPN transistor level shift)
LED_CHANNEL = 0
strip = Adafruit_NeoPixel(LED_COUNT, LED_PIN,
LED_FREQ_HZ, LED_DMA, LED_INVERT, LED_BRIGHTNESS,
LED_CHANNEL)
```

Additionally, the first stage (35) of the present example includes defining the message to be displayed on the light-emitting device (3). In this case, the message is "PRETECOR LT SMART", and it is selected to be displayed in red color. A fragment of the Python code for this part of the first stage is shown below (35).

```
#*****************************************************
*********************
class Pretecor:
        def _init_(self):
            self.message = 'PRETECOR LT SMART'
            self.Red = 255
            self.Green = 0
            self.Blue = 0
            self.Length=1
#*****************************************************
*********************
        def screen(self, message, r, g, b):
            self.message = str(message)
            self.Red = r
            self.Green = g
            self.Blue = b
```

Subsequently, the method executes the second stage (36) and the third stage (37). First, a counter is initialized to perform a displacement of the message characters from a first end of the light-emitting device (3) to a second end thereof. In turn, the third stage (37) corresponds to a first conditional enabling data flow between the control unit (5) towards the light-emitting device (3), wherein the data flow enables displaying and shifting the characters from a first end of the light-emitting device (3) towards a second end thereof. Below, a Python code fragment of a conditional that groups the second stage (36) and the third stage (37) is shown (37):

```
for self.i in range(0,len(self.message)*8+self.Length): #
    Displacement of text
```

In addition, below there is a fragment of the Python code where the fifth stage (39), in which the screen is darkened, is executed:

```
Pretecor.CleanScreen(Color(0, 0, 0)) # Clean the screen
Pretecor.Message(self.message, self.i, Color(self.Green,
    self.Red, self.Blue))
time.sleep(0.03)
strip.show( )#Show the program
```

```
#*****************************************************************
*****
```

Subsequently, a fragment of the Python code corresponding to the sixth stage (40) is shown, in which each character of the message is programmed in a hexadecimal number.

```
    #Message converted to each letter, number or symbol
    @staticmethod
    def Message(message, position3, color):
        #Hexadecimal Letters
        LetterA = [0 × 3E,0 × 48,0 × 88,0 × 48,0 × 3E] # Letter A in hexadecimal
        LetterB = [0 × 6C,0 × 92,0 × 92,0 × 92,0 × FE] # Letter B in hexadecimal
        LetterC = [0 × 44,0 × 82,0 × 82,0 × 82,0 × 7C] # Letter C in hexadecimal
        LetterD = [0 × 7C,0 × 82,0 × 82,0 × 82,0 × FE] # Letter D in hexadecimal
        for i in range(0,len(message)):
            if message[i] == 'A':
                Pretecor.Letters2Led(position3−8*i,color,LetterA)
            if message[i] == 'B':
                Pretecor.Letters2Led(position3−8*i,color,LetterB)
            if message[i] == 'C':
                Pretecor.Letters2Led(position3−8*i,color,LetterC)
            if message[i] == 'D':
#*****************************************************************
*****
```

This example shows the programming of the letters A, B, C and D. A similar process is used to program the other characters, such as the other letters of the alphabet, numbers, punctuation marks, question marks, exclamation marks, and other literary signs, or customized symbols such as emoticons, geometric figures and patterns, among others.

Now, we show the Python code programming of the method seventh step (41) in this example, where each hexadecimal number is converted into a binary number:

```
    #Binary converted to LEDs
    @staticmethod
    def Bin2Led(hexa,position,color,direction):
        ConvBin = bin(hexa)
        if direction == 0:
            for i in range(2,len(ConvBin)):
                if ConvBin[i]=='0':
                    strip.setPixelColor(position+len(ConvBin)-i, Color(0, 0, 0))
                else:
                    strip.setPixelColor(position+len(ConvBin)-i, color)
        else:
            for i in range(2,len(ConvBin)):
                if ConvBin[i]=='0':
                    strip.setPixelColor(position-len(ConvBin)+i, Color(0, 0, 0))
                else:
                    strip.setPixelColor(position-len(ConvBin)+i, color)
#*******************************************************************
*****
```

The Python code programming of the method eighth stage (42) in the present example is shown below, the binary numbers of the seventh stage (41) are translated into turn-on sequences (ninth stage (43)) and turn-off or dimming (tenth stage (44)) of the light-emitting device (3) LEDs. When the light-emitting device (3) turns the LEDs on and off according to the ninth stage (43) and tenth stage (44) on and off sequences, the eleventh stage (45) is executed in which the message is displayed on the display formed by the LEDs of the light-emitting device (3).

```
    #Letters converted to Leds
    @staticmethod
    def Letters2Led(position2,color,hexa):
        if position2 > Length-9:
            dif = Length-1-position2
            #print(dif)
            if dif >= 0:
                Pretecor.Bin2Led2(hexa[4],position2,Color(0, 0, 0),0,dif)
                Pretecor.Bin2Led2(hexa[3],2*Length-position2-1,Color(0, 0, 0),1,dif)
                Pretecor.Bin2Led2(hexa[2],2*Length+position2,Color(0, 0, 0),0,dif)
                Pretecor.Bin2Led2(hexa[1],4*Length-position2-1,Color(0, 0, 0),1,dif)
                Pretecor.Bin2Led2(hexa[0],4*Length+position2,Color(0, 0, 0),0,dif)
        if position2 < -1:
            dif2 = position2*-1
            if dif2 >= 0:
                for i in range(position2+dif2, position2+8):
                    Pretecor.Letters(i,Color(0,0, 0))
        else:
            Pretecor.Bin2Led(hexa[4],position2,color,0)
            Pretecor.Bin2Led(hexa[3],2*Length-position2-1,color,1)
            Pretecor.Bin2Led(hexa[2],2*Length+position2,color,0)
            Pretecor.Bin2Led(hexa[1],4*Length-position2-1,color,1)
            Pretecor.Bin2Led(hexa[0],4*Length+position2,color,0)
#*******************************************************************
*****
    #Clean screen
    @staticmethod
    def CleanScreen(color):
        for i in range(LED_COUNT):
            strip.setPixelColor(i, color)
```

Glossary

Logic level conversion interface: it is an electronic logic level converter circuit with at least one input and at least one output, which is selected among others from a specific purpose integrated circuit, an arrangement of capacitors, resistors, diodes, coils, transformers and combinations thereof, which allow to increase or decrease the voltage level between at least one input and at least one output of said electronic logic level converter circuit, wherein the output corresponds proportionally to the input and vice versa.

Control signal: it is understood as the electrical signal sent by the control unit to an electronic element to govern its behavior.

Light-emitting device (3): it is an object that emits light in the visible spectrum, where such light emission is carried out in a controlled manner.

Visual signal: it is a control signal that governs the behavior of the light-emitting device (3) such signal may be a text message, images or light patterns.

Monitoring signal: it is the electrical signal coming from a sensor (7), such electrical signal varies its voltage and/or current based on a variation of the magnitude of at least one physical variable.

Control unit (5): it is a device that processes data and issues external control signals (commands) to control one or more electronic elements.

Communication module: it is an electronic device that allows sending and/or receiving data between two or more electronic elements.

Monitoring of a sensor: observing the course of one or more physical or other parameters by means of electronic elements.

LED strips: they may be one or more linear arrays of LED vectors, wherein a LED vector is a sequence of a plurality of LEDs extending on one or more predetermined directions. The LED strips may be arranged with respect to each other to form a display, which may be curved or flat, and which is configured to display a plurality of characters and/or symbols by turning on and off or dimming the LEDs of the LED strips.

It shall be understood that the present invention is not limited to the embodiments described and illustrated, for as will be evident to a person skilled in the art that there are possible variations and modifications which do not depart from the invention spirit, defined by the following claims.

The invention claimed is:

1. A smart post, comprising:

a structural body with an internal cavity, said structural body being made of a translucent material;

a support body disposed in the internal cavity of the structural body, wherein the support body extends along the structural body, wherein the support body has at least one positioning fixture, wherein the positioning fixture is a plate with a perforation; and wherein, the perforation is a slot, said slot containing the light-emitting device and the support body;

a light-emitting device located between the structural body and the support body, wherein the light-emitting device is supported on the support body;

a control unit connected to the light-emitting device;

wherein the light-emitting device is configured to display visual signals, said visual signals being sent by the control unit;

wherein the structural body protects the light-emitting device and the control unit from environmental conditions.

2. The post of claim 1, wherein the light-emitting device is arranged on the outer surface of the support body by means of a fixing element.

3. The post according to claim 1, wherein the shape of the structural body is a truncated cone shape or a cylindrical shape.

4. The post according to claim 1, wherein the structural body material is selected from the group consisting of glass fiber reinforced polyester (GRP), polymethylmethacrylate (PMMA), polyvinyl chloride (PVC), chlorinated polyvinyl chloride (CPVC), high density polyethylene (HDPE), polypropylene (PP); polyethylene terephthalate (PET), polyamides (PA) (PA12, PA6, PA66); polychlorotrifluoroethylene (PCTFE); polyvinylidene fluoride (PVDF); polytetrafluoride ethylene (PTFE); ethylene-chlorotrifluoroethylene (ECTFE); plastics (polyester, vinyl ester, epoxy, vinyl resins) reinforced with fibers (glass, aramid, polyester) and combinations thereof.

5. The post according to claim 1, wherein the translucent material of the structural body is glass fiber reinforced polyester (GRP).

6. The post according to claim 1, wherein the light-emitting device is selected from the group consisting of LED diodes, laser diodes, cathode ray tube, liquid crystal displays, plasma light, and combinations thereof.

7. The post according to claim 1, wherein the light-emitting device is formed by LED diodes, wherein the arrangement of LED diodes is selected from the group consisting of LED arrays, LED ribbons, and combinations thereof.

8. The post according to claim 1, wherein the positioning fixture is a plate with at least two perforations, wherein one perforation houses the support body and the other perforation houses the light device in the form of LED strips.

9. The post according to claim 1, wherein the support body has primary positioning fixtures; and secondary positioning fixtures;

wherein, the primary and secondary positioning fixtures are located spaced from each other along the support body;

wherein, the primary positioning fixtures are plates with at least two perforations, wherein one perforation houses the support body and the other houses the light device in the form of LED strips;

wherein, the secondary positioning fixtures are plates with at least one perforation, wherein said perforation of each secondary positioning fixture houses the support body and the outer surface of each plate serves as a support for the light-emitting device in the form of LED strips.

10. The post according to claim 1, wherein at least one sensor is arranged in the structural body, wherein the sensor is connected to the control unit.

11. The post according to claim 10, wherein the sensor is selected from the group consisting of proximity sensors, vibration sensors, environmental condition sensors (temperature, humidity, dew point, wind speed, solar radiation, noise), pressure sensors, air quality sensors, particulate matter concentration (PST, Pm10, PM25), gas sensors (sensors for measuring concentration or presence of ozone, methane, sulfur, carbon monoxide, $CO_2$, butane, smoke, alcohol, natural gas, flammable gases, benzene, ammonia, toluene, acetone, propane, formaldehyde, hydrogen), solar radiation sensor, wind speed sensor, seismic sensors, liquid fluid level sensors, and combinations thereof.

12. The post according to claim 1, wherein the control unit is connected to a communication module.

13. The post according to claim 12, wherein the communication module is wireless and uses a wireless communication technology selected from the group consisting of Bluetooth, Wi-Fi, Radio Frequency RF ID (for Radio Frequency Identification), UWB (for Ultra Wide B-and), GPRS, Konnex o KNX, DMX (for Digital MultipleX), Wi-Max, LIFI, ZigBee, LoRa/LoRaWan, communication protocols derived from 3G, 4G, 5G, GSM/GPRS, EDGE, and combinations thereof.

14. The post according to claim 1, wherein at least one USB port is disposed on the structural body and is connected to the control unit.

15. A lighting system comprising:

a first smart post and a second smart post, wherein each smart post is the smart post of claim 1 wherein the control unit of the first smart post is configured as a master processor and the control unit of the second smart post is configured as a slave processor, dependent on the control unit of the first smart post.

16. A method for controlling a smart post, comprising the following steps:

a) providing a smart post, formed by:

a structural body with an internal cavity, said structural body being made of a translucent material;

a support body disposed in the internal cavity of the structural body, wherein the support body extends along the structural body, wherein the support body has at least one positioning fixture, wherein the positioning fixture is a plate with a perforation; and wherein, the perforation is a slot, said slot containing the light-emitting device and the support body;

a light-emitting device located between the structural body and the support body, wherein the light-emitting device is supported on the support body;

a control unit connected to the light-emitting device;

wherein the light-emitting device is configured to display visual signals, said visual signals being sent by the control unit;

wherein the structural body protects the light-emitting device and the control unit from environmental conditions;

b) entering a configuration parameter in a control unit;

c) generating a control signal in the control unit based on the configuration of step b);

d) sending the control signal from the control unit to the light-emitting device;

wherein the control signal of stage d) controls the light-emitting device to emit visual signals; and wherein the visual signal is selected from the group of text messages, images, light patterns and a combination thereof.

17. The method according to claim 16, wherein the control signal is sent via a logic level conversion interface to the light-emitting device.

18. The method according to claim 16, wherein the generation of the control signal in the control unit in step b) corresponds to monitoring a sensor and the configuration of step a).

19. The method according to claim 18, wherein the monitoring of the sensor has the following sub-steps:

obtaining a monitoring signal from the surroundings of the smart post by means of a sensor;

sending the monitoring signal from the sensor to the control unit;

verifying the monitoring signal sent by the sensor in the control unit, according to the following conditions:

if the monitoring signal is not detected, a control signal is generated in the control unit based on the settings of step a) and proceeds to step c);

if the monitoring signal is detected, a control signal is generated in the control unit based on the settings of stage a) and the monitoring signal sent by the sensor in the control unit and proceeds to stage c).

20. The method according to claim 19, wherein the sensor is a proximity sensor and each time the control unit detects a monitoring signal from the sensor it increases a people counter to, then, verify the following conditions:

if the information time is greater than or equal to a value set in the control unit then a control signal is generated, so in stage c) it controls the light-emitting device to emit a visual signal in the form of a text message including the number of people who have passed by the smart post;

if, on the other hand, the information time is not greater than a value set in the control unit then a control signal is generated, so in stage c) it controls the light-emitting device to emit a visual signal in the form of a text message with a welcome message.

21. The method according to claim 19, further comprising:

executing a first stage wherein a plurality of configuration parameters are entered, wherein one of the configuration parameters are some characters of a message, and a length of a display of the light-emitting device;

executing in a second stage the initialization of a value counter (i) defining an activation of some activation zones of the light-emitting device, wherein each activation zone corresponds to an area of the light-emitting device screen;

executing in a third stage a conditional, wherein:

if all characters of the message were displayed on at least one activation zone of the light-emitting device display, then the method is terminated, otherwise it proceeds to a fourth stage;

executing the fourth stage wherein the counter of the second stage is increased by a value, wherein the increase of the counter is visually translated into a displacement of the characters displayed on the screen from a first end where an activation zone with a minimum value (i) is located towards a second end of the screen with a maximum value (i);

executing a fifth stage in which the light-emitting device screen is cleaned;

executing a sixth stage in which each character of the first stage message is converted to a hexadecimal number;

executing a seventh stage in which each hexadecimal number of the sixth stage is converted into a binary number;

executing an eighth stage in which each binary number is associated with an activation and deactivation/darkening sequence of some lighting means, LEDs, or pixels of the display of the light-emitting device; wherein turning on the lighting means a tenth stage is executed, and turning off or darkening the lighting means a ninth stage is executed;

executing a ninth stage in which one or more characters of the message are displayed on the activation zones of the display; and the third stage conditional is executed again until all characters of the message were displayed on at least one activation zone of the light-emitting device display.

* * * * *